US007965958B2

(12) United States Patent
Tatsumi et al.

(10) Patent No.: US 7,965,958 B2
(45) Date of Patent: Jun. 21, 2011

(54) DEVELOPING DEVICE, PROCESS CARTRIDGE AND IMAGE FORMING APPARATUS

(75) Inventors: Kenzo Tatsumi, Osaka (JP); Yoshihiro Kawakami, Hyogo (JP); Yoshiyuki Shimizu, Osaka (JP); Tomohiro Kubota, Osaka (JP); Hirobumi Ooyoshi, Tokyo (JP); Tomofumi Yoshida, Tokyo (JP); Koji Kato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 392 days.

(21) Appl. No.: 12/117,895

(22) Filed: May 9, 2008

(65) Prior Publication Data

US 2008/0279586 A1 Nov. 13, 2008

(30) Foreign Application Priority Data

May 11, 2007 (JP) ..... 2007-126872

(51) Int. Cl.
*G03G 15/04* (2006.01)

(52) U.S. Cl. ..... 399/119; 399/279

(58) Field of Classification Search ..... 399/117, 399/119, 126, 279

See application file for complete search history.

(56) References Cited

U.S. PATENT DOCUMENTS

| | | | | |
|---|---|---|---|---|
| 5,669,042 | A * | 9/1997 | Kobayashi et al. | 399/111 |
| 7,099,613 | B2 * | 8/2006 | Nakamura et al. | 399/286 |
| 2006/0268373 | A1 | 11/2006 | Tatsumi et al. | |
| 2007/0092285 | A1 * | 4/2007 | Oguma et al. | 399/90 |
| 2007/0104523 | A1 | 5/2007 | Yoshida et al. | |
| 2007/0140763 | A1 | 6/2007 | Shimizu et al. | |
| 2007/0248390 | A1 | 10/2007 | Kubota et al. | |

FOREIGN PATENT DOCUMENTS

| | | |
|---|---|---|
| JP | 63-88861 | 6/1988 |
| JP | 9-106184 | 4/1997 |
| JP | 10-282752 | 10/1998 |
| JP | 2868537 | 12/1998 |
| JP | 11-249481 | 9/1999 |
| JP | 2006-48018 | 2/2006 |

* cited by examiner

*Primary Examiner* — David M Gray
*Assistant Examiner* — Barnabas T Fekete
(74) *Attorney, Agent, or Firm* — Oblon, Spivak, McCelland, Maier & Neustadt, L.L.P.

(57) ABSTRACT

A developing device that supplies developer to an image carrier. In a developing device having a developer carrier that is driven in rotation by drive force applied to a gear provided on the shaft section thereof, the developer carrier being pressed in the direction of the image carrier, the effect of the gear drive force on the pressing force of the developer carrier onto the image carrier can be eliminated. The bearing that supports the shaft section is made slidable and the sliding direction of the bearing with respect to the direction of the drive force is set at about 90°.

14 Claims, 21 Drawing Sheets

DEVELOPING DEVICE, PROCESS CARTRIDGE AND IMAGE FORMING APPARATUS

BACKGROUND OF THE INVENTION

1. Field of the Invention

The present invention relates to an image forming apparatus such as a printer, a facsimile apparatus, a copier or a combined apparatus based on an electrophotographic system whereby an image is developed using minute particles such as toner, and in particular relates to a process cartridge that is used in an image forming apparatus and to a developing device used in the process cartridge.

2. Description of the Related Art

The developer carrier that is employed in an electrophotographic apparatus is located in position with a minute gap or making very slight contact with respect to the image carrier. The location means may be means that completely fixes the developer carrier and the image carrier or may be means that presses the developer carrier in the image carrier direction. In such a configuration, typically the drive force onto the developer carrier is transmitted by gears.

If the developer carrier, which is the rotating body, is of a configuration that is driven at one end side in the direction of its axis of rotation, a difference between left and right (difference between the drive side and the side opposite to the drive side) may be generated in the pressing force applied to the image carrier by the gear drive force that is received on one side.

A technique relating to a developing device that supplies developer to the image carrier and comprising a developer carrier that is driven in rotation by drive force applied to a gear provided on the shaft thereof, so that the developer carrier is pressed in the direction of the image carrier is proposed in Japanese Patent Application Laid-open No. H10-282752 (called Prior Art 1) and Japanese Patent Application Laid-open No. H09-106184 (called Prior Art 2).

Prior Art 1 proposes a technique wherein a configuration is adopted such that the toner carrier is pressed in the direction of the center of rotation of the electrophotographic photosensitive body when drive force is transmitted to the toner carrier, and Prior Art 2 proposes a technique wherein positional location of the photosensitive body and the developing roller is effected by mutually pressing into contact the bearings of the photosensitive body and the bearings of the developing roller of the developing device by pressing the developing device towards the photosensitive body by a pressing spring. Thus, in the spring pressing type, even if the pressing force on the drive side is altered by applying a correction in an amount corresponding to the drive force, the end result is still that a difference is generated between the drive side and the side opposite to the drive side by variability of the torque.

Also, the method has been proposed of providing a gap roller or contacting roller at both ends of the developer carrier. However, in addition to increased costs, bending about the roller is produced in the developer carrier by the drive force, leading to the variability of the gap or contact nip in the axial direction with respect to the photosensitive body.

Thus, whichever of these is adopted, the problem that a left/right difference (difference between the drive side and the side opposite to the drive side) in the pressing force onto the image carrier is generated by the drive force of the gear being received on one side cannot be said to be solved.

Also, an image forming apparatus has been proposed in for example Japanese Patent Application Laid-open No. 2006-48018 (called Prior Art 3) having a configuration wherein the amount of the nip between the photosensitive body and the developing roller is set to a prescribed value by adjusting the distance between the shafts of the photosensitive body and the developing roller by means of an adjustment jig that rotates an eccentric bearing member that supports the developing roller. In such an image forming apparatus, an eccentric cam and a mechanically assembled component that rotates this must be assembled.

Technologies relating to the present invention are also disclosed in e.g. Japanese Patent Application Laid-open No. H02-868537.

SUMMARY OF THE INVENTION

The present invention provides a process cartridge and developing device used in an image forming apparatus wherein the effect of the gear drive force on the pressing force of the developer carrier onto the image carrier is prevented.

In an aspect of the present invention, a developing device comprises a developer carrier that is driven in rotation by drive force applied to a gear provided on a shaft section thereof. The developer carrier is pressed in the direction of an image carrier. A bearing that supports the shaft section is made slidable and the sliding direction of the bearing is set at about 90° with respect to the direction of the drive force.

In another aspect of the present invention, a developing device comprises a developer carrier that is driven in rotation by drive force applied to a gear provided on a shaft section thereof. The developer carrier is pressed in the direction of an image carrier. A bearing that supports the shaft section is made slidable. The pressing force Fk with which the bearing is pressed on the side where the gear is provided in the longitudinal direction of the shaft section and the pressing force Fh with which the bearing is pressed on the side opposite to the side where the gear is provided in the longitudinal direction of the shaft section are respectively set as follows in accordance with the magnitude of an angle (θ) of the sliding direction of the bearing with respect to the direction of the drive force:

when $\theta<90°$: $Fk>Fh$;

when $\theta=90°$: $Fk=Fh$; and when $\theta>90°$: $Fk<Fh$.

In another aspect of the present invention, a process cartridge is detachable with respect to the main body of an image forming apparatus and integrally supports at least a developing device and an image carrier. The developing device comprises a developer carrier that is driven in rotation by drive force applied to a gear provided on a shaft section thereof. The developer carrier is pressed in the direction of an image carrier. A bearing that supports the shaft section is made slidable and the sliding direction of the bearing is set at about 90° with respect to the direction of the drive force.

In another aspect of the present invention, an image forming apparatus comprises a process cartridge which is detachable with respect to the main body of an image forming apparatus and integrally supports at least a developing device and an image carrier. The developing device comprises a developer carrier that is driven in rotation by drive force applied to a gear provided on a shaft section thereof and that presses the developer carrier in the direction of an image carrier. The bearing supports the shaft section is made slidable and the sliding direction of the bearing is set at about 90° with respect to the direction of the drive force.

BRIEF DESCRIPTION OF THE DRAWINGS

The above and other objects, features and advantages of the present invention will become more apparent from the following detailed description taken with the accompanying drawings, in which.

DESCRIPTION OF THE PREFERRED EMBODIMENT(s)

An embodiment of the present invention is described in detail below with reference to the drawings.

[1] Configuration and Operation of the Image Forming Apparatus

First of all, the configuration and operation of an image forming apparatus to which the present invention is applied will be described.

Figure 1:
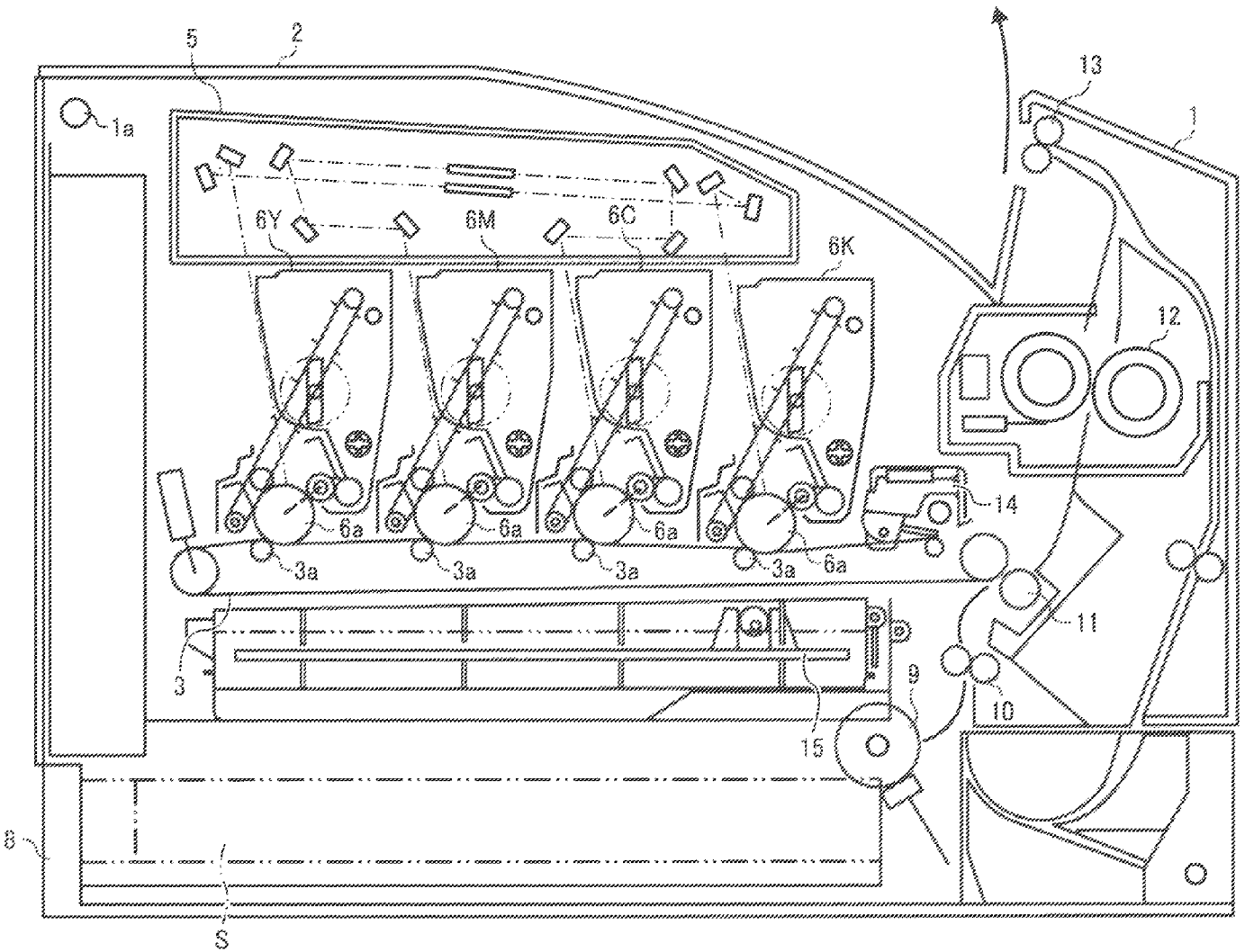
FIG. 1 is a cross-sectional view showing the diagrammatic configuration of a color electrophotographic apparatus to which the present invention is applied.

FIG. 1 shows an example of an image forming apparatus, and shows diagrammatically the configuration of the color electrophotographic device. In the color electrophotographic device 1, image-forming units 6 are arranged in sequence in substantially the middle of the frame of the apparatus (the black image-forming unit is indicated by 6K, the cyan image-forming unit is indicated by 6C, the magenta image-forming unit is indicated by 6M, and the yellow image-forming unit is indicated by 6Y. Where separate designation of each color is too complicated, the suffixes K, C, M and Y etc are dispensed with. The same applies to the other members.)

At the top of the image-forming units 6 there is arranged an exposure device 5 for forming a latent image on an image carrier 6*a* comprising for example a photosensitive drum. Below the image-forming units 6, there is arranged a transfer belt 3 in the left/right direction, supported by support rollers provided at the left and right. The transfer belt 3 is driven in rotation in an anti-clockwise direction. A second transfer device 11 that transfers a toner image onto a recording medium constituted by a medium in the form of a sheet is provided facing the support roller provided at the right-hand end of the transfer belt 3. An intermediate transfer body cleaning device 14 is arranged on the direction of rotation of the transfer belt 3, in a position on the downstream side of the second transfer device 11 and on the upstream side of the black image-forming unit 6K.

A used toner recovery container 15 is arranged below the transfer belt 3; below the used toner recovery container 15, there is arranged a paper feed cassette 8 in which recording media S are stacked and accommodated. The recording media S are separated into individual sheets, which are delivered and supplied by a paper feed device 9; these recording media S pass through between the transfer belt 3 and the second transfer device 11 and are guided to a fixing device 12, where a toner image is thermally fixed on a recording medium S.

The image-forming units 6 will now be described with reference to FIG. 2. In the toner hopper 6*b* that is integral with the developing device 16, toner of four different colors (black, cyan, magenta, and yellow) corresponding to the black image-forming unit 6K, the cyan image-forming unit 6C, the magenta image-forming unit 6M and the yellow image-forming unit 6Y is packed as a fine coloring powder.

Around the latent image holding means constituted by the image carrier (in this example, a photosensitive drum) 6*a*, there are arranged: a developing roller 6*h* constituting a developer carrier that supplies toner to the image carrier 6*a*; a cleaning blade 6*c* that scrapes off residual toner after the primary transfer, in which an image developed by the toner is transferred to the transfer belt, has been performed; a charging roller 6*d* that contacts the image carrier 6*a*; a toner feed screw 6*e* that feeds the toner that has been scraped off horizontally; a toner feed belt 6*f* whereby toner from the toner feed screw 6*e* is picked up; and a used toner recovery section 6*g* whereby the toner is recovered.

Next, the process as far as electrophotographic image formation will be described.

Figure 2:
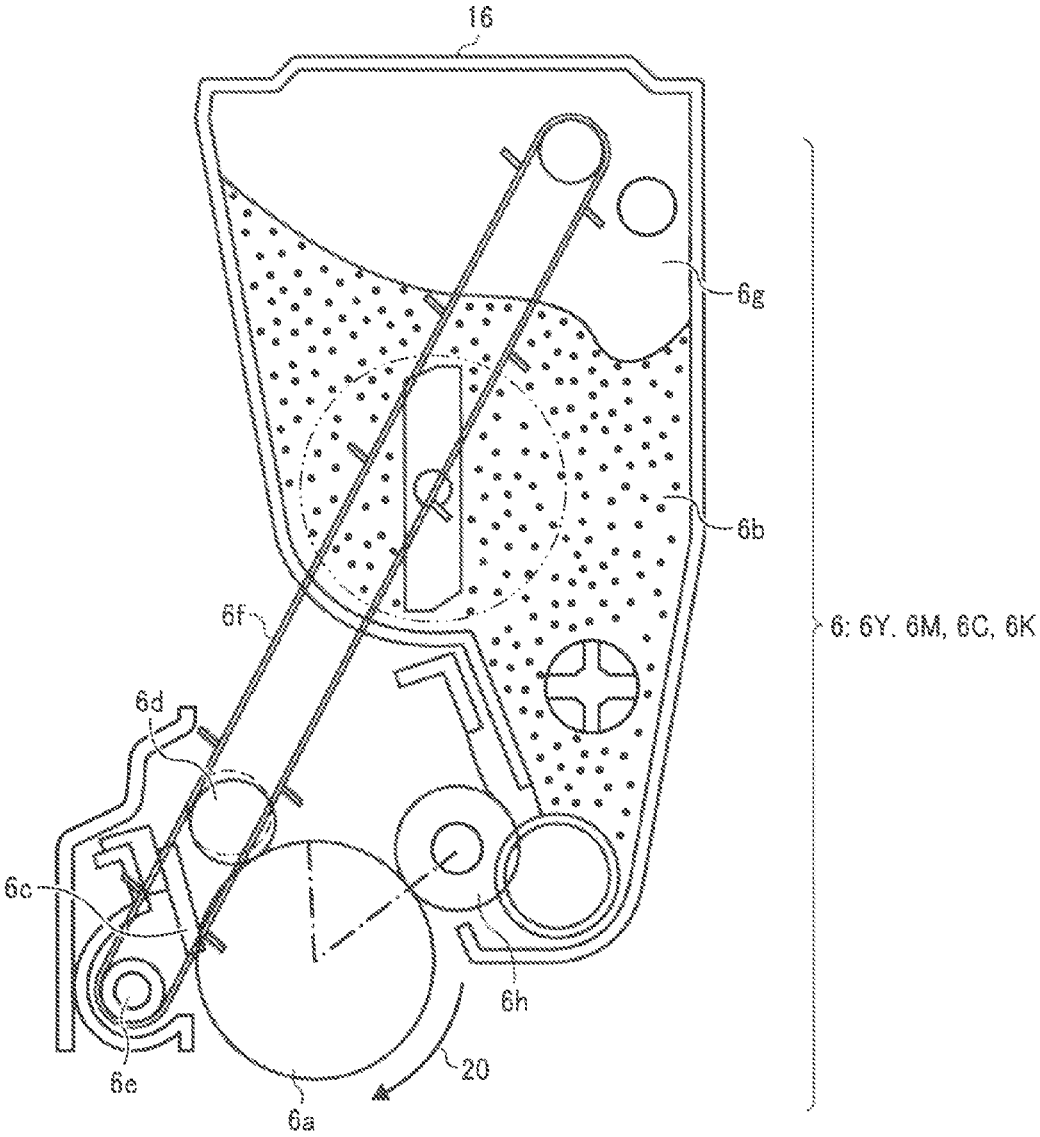
FIG. 2 is a side view showing the internal configuration of an image-forming unit of the color electrophotographic apparatus.

In FIG. 2, the image carrier 6*a* is rotated by a drive device (not shown) in the direction indicated by the arrow 20 and the photosensitive layer at the surface thereof is initialized by being charged up to a uniform high potential by the charging roller 6*d*.

The photosensitive layer of the image carrier 6*a* that has been charged up in this way to uniform high potential is selectively exposed in accordance with image data by a scanning exposure beam from an exposure device 5 and an electrostatic latent image is thereby formed comprising high potential regions produced by the initialization and low potential regions whose potential has been attenuated by this exposure.

Next, when the low potential regions (or high potential regions) of the electrostatic latent image from the developing roller 6*h* formed with a thin layer of toner on the surface thereof reach a contacting position, the toner is transferred to form a toner image (i.e. the image is developed). After the primary transfer, the cleaning blade 6*c* contacting the image carrier 6*a* cleans residual toner from the surface of the image carrier 6*a* so that it is available for the formation of subsequent toner images.

The description is continued with reference to FIG. 1. A first transfer roller 3*a* is arranged in the position where the image-forming unit 6 contacts the transfer belt 3, so that, by application of high potential to the first transfer roller 3*a*, a potential difference is created between the image carrier (photosensitive drum) 6*a* and the transfer belt 3, causing the toner image formed on the surface of the image carrier (photosensitive drum 6*a*) to be transferred.

Toner images of each of these colors are successively transferred to the transfer belt 3 by the image-forming units 6K, 6C, 6M and 6Y, and a color toner image of a plurality of colors is thereby formed by superposition of monochromatic toner images on the transfer belt 3.

Next, a recording medium S such as a paper or OHP sheet is fed, with this timing, from the paper feed device 9 and paper conveying device (facing rollers) 10, to the second transfer position (position in which the second transfer device 11 and the transfer belt 3 are opposite to each other), and the monochromatic or color toner image that is formed on the surface of the transfer belt 3 is transferred to the recording medium 7 by transferring this toner image formed on the surface of the transfer belt 3 by establishing a potential difference between the transfer belt 3 and the second transfer device 11 by application of high potential to the second transfer device 11.

The recording medium S onto which the toner image has thus been transferred is separated from the transfer belt 3 and the toner image is melt-fixed onto the recording medium S by means of a fixing device 12: the recording medium is then discharged into a paper discharge tray at the top face of the color electrophotographic apparatus 1 by a paper discharge device (facing rollers) 13.

Excess toner remaining on the surface of the transfer belt 3 after transfer of the toner image to the recording medium 7 is cleaned off by an intermediate transfer body cleaning device 14 and recovered into the used toner recovery container 15. The cleaned transfer belt 3 is then ready for transfer of the next toner image.

Paper jamming during conveying can be prevented and reliability improved by simplifying as far as possible the conveying path from paper feed (paper feed device 9) of the recording medium 7 to paper discharge (paper discharge device 13) and increasing the radius of curvature of the conveying path. Also, the remedial operations for removing a paper jam should this occur can be performed in a simple fashion and, furthermore, employment of a color electrophotographic apparatus of a kind in which various types of recording media, including for example thick paper, can be employed is also possible.

In the example of this embodiment, the recording medium conveying path from data feed (paper feed device 9) to paper discharge (paper discharge device 13) is formed in substantially arcuate shape and the transfer belt 3, image-forming units 6 and exposure device 5 are arranged on the inside of the recording medium conveying path: the space within the frame of the apparatus can thereby be effectively utilized, so that miniaturization can be achieved, the conveying path is simplified, and an arrangement is achieved in which the image face is downwardly directed when the recording medium 7 is discharged.

By means of this configuration, the conveying path can be simplified and practically all of the structural units are arranged on the inside of the conveying path: the conveying path can therefore be close to the frame of the apparatus, so that the conveying path can easily be opened, simplifying the remedial operations for removing a paper jam should this occur.

By arranging for the recording medium S to be discharged on the color electrophotographic apparatus 1 with its image face directed downwards, when the recording media S stacked on the color electrophotographic apparatus 1 are removed with their image faces directed upwards, the advantage is obtained that they will be stacked arranged in the printing order from top to bottom.

Thanks to the adoption of a configuration wherein the right-hand side in FIG. 1 is the front face that is directly opposite to the operator, the remedial actions for removing a paper jam should this occur are simplified.

Since the arrangement is such that the top (paper discharge tray 2) of the color electrophotographic apparatus 1 is opened about a shaft la at the top left, taking with it the exposure device 5, the image-forming units 6, which are consumables, can be replaced from the front face by the operator. Thanks to this front face access configuration, in which all of the series of actions can be performed from the front face, a color electrophotographic apparatus can be implemented at any installation location.

If the image-forming unit 6 is constructed as a unit that is detachable with respect to the image forming apparatus such as the color electrophotographic apparatus 1, such an image-forming unit is termed a process cartridge. A process cartridge includes at least an image carrier and developing device.

[2] Configuration Relating to Sliding of the Bearings

In FIG. 2, an arrangement is adopted wherein the developer carrier 6*h* in the developing device 16 is separated by a minute gap with respect to the image carrier 6*a* or is in contact therewith: it is thus able to realize a latent image on the photosensitive body that is provided at the peripheral surface of the image carrier 6*a*. The configuration of the image-forming unit 6 including the developing device 16 is shown in disassembled condition in FIG. 3.

Figure 3:
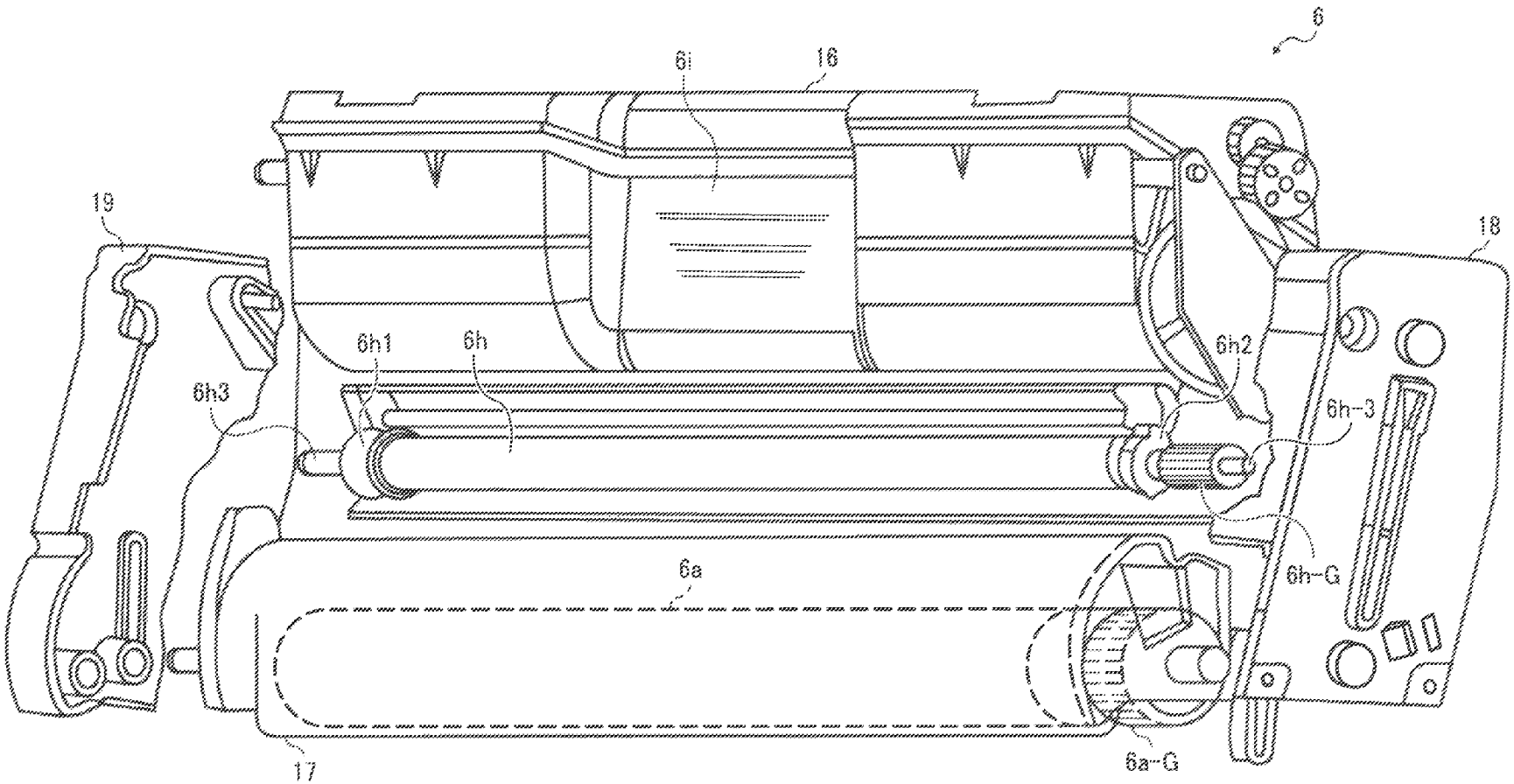
FIG. 3 is an exploded perspective view of the image-forming unit.
Figure 4:
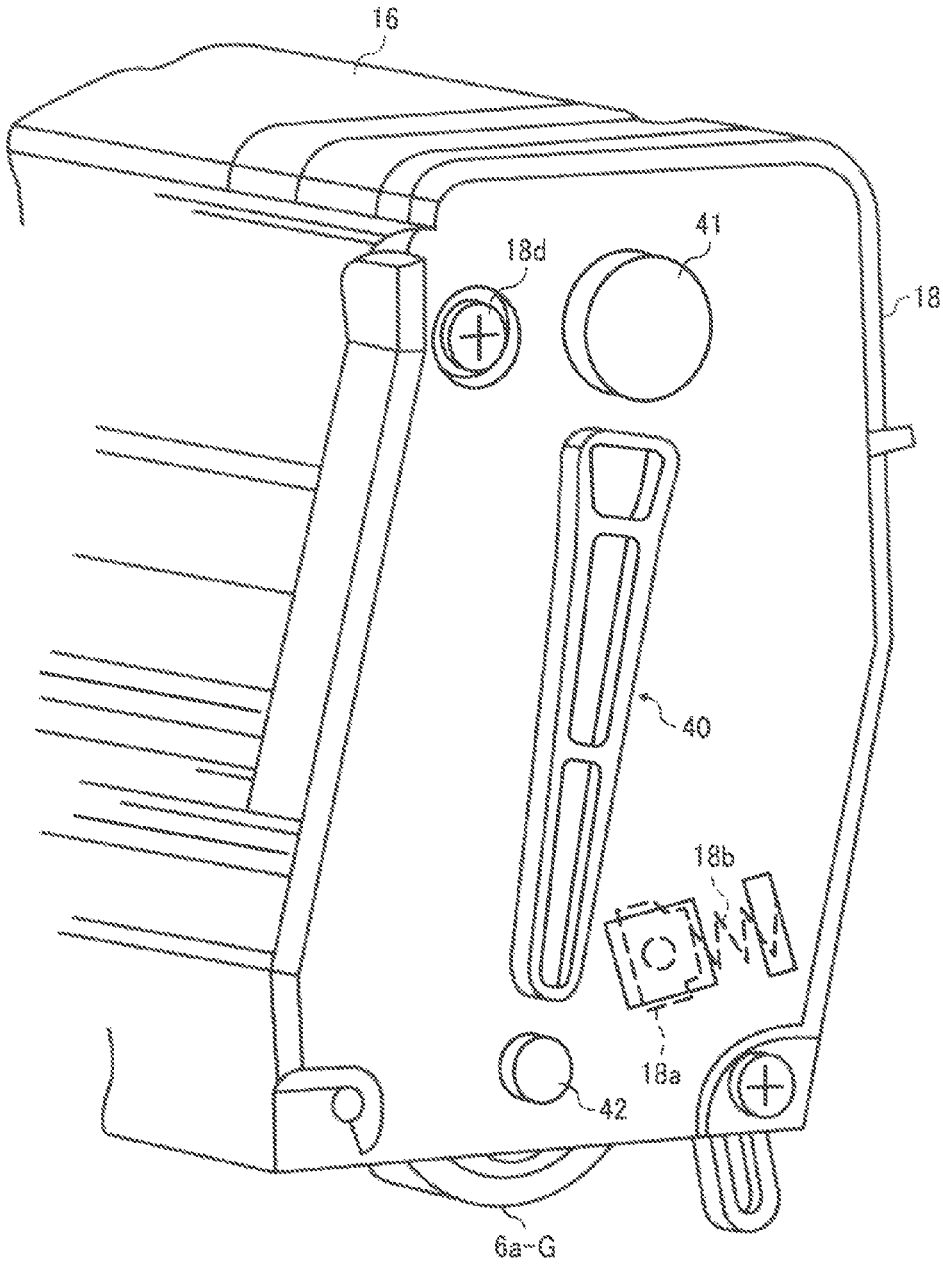
FIG. 4 is an exploded perspective view of a part of the image-forming unit.
Figure 5:
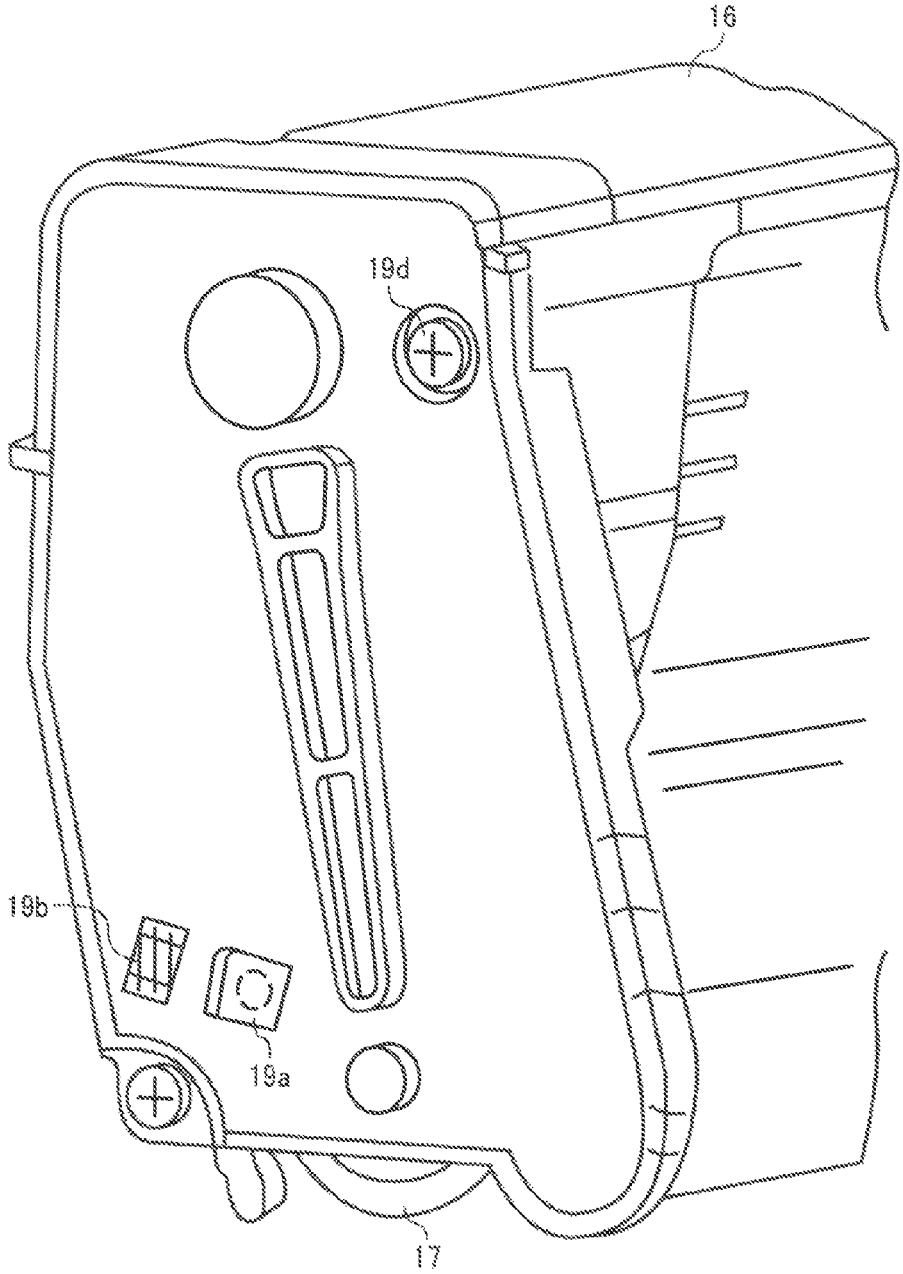
FIG. 5 is an exploded perspective view of another part of the image-forming unit.

In FIG. 3, the image-forming unit 6 is shown in a condition in which it is disassembled into the four constituent elements namely, the developing device 16 that is a characteristic feature of the present invention (also called developer carrier unit or developing unit), image carrier unit 17, and left faceplate 18 and right faceplate 19 that support these (the developing device 16 and image carrier unit 17). In addition, FIG. 4 shows the image-forming unit 6 in assembled condition with the portion of the left faceplate 18 shown to a larger scale and FIG. 5 shows the image-forming unit 6 in assembled condition with the portion of the right faceplate 19 shown to a larger scale.

Figure 6:
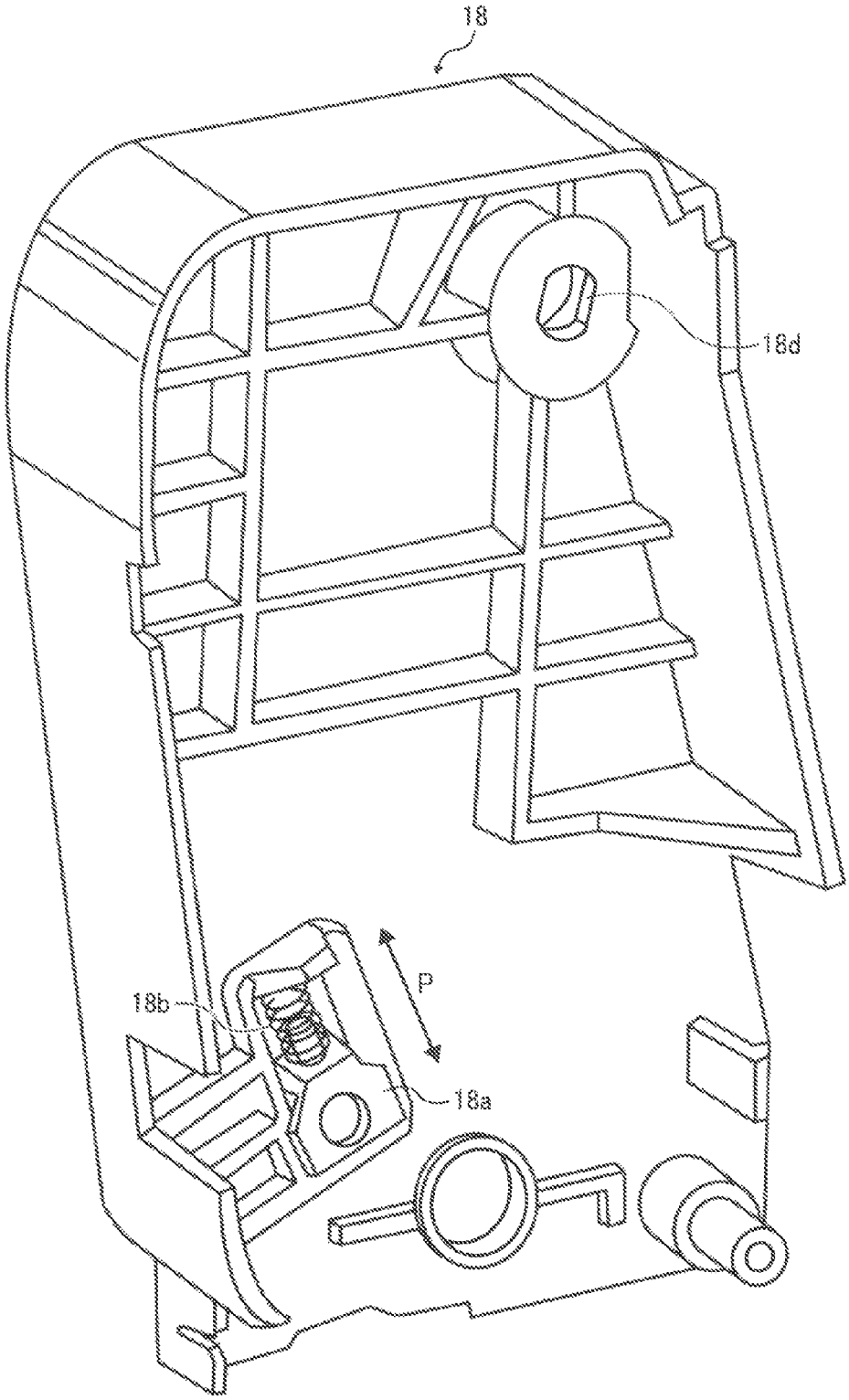
FIG. 6 is a perspective view showing a faceplate.
Figure 7:
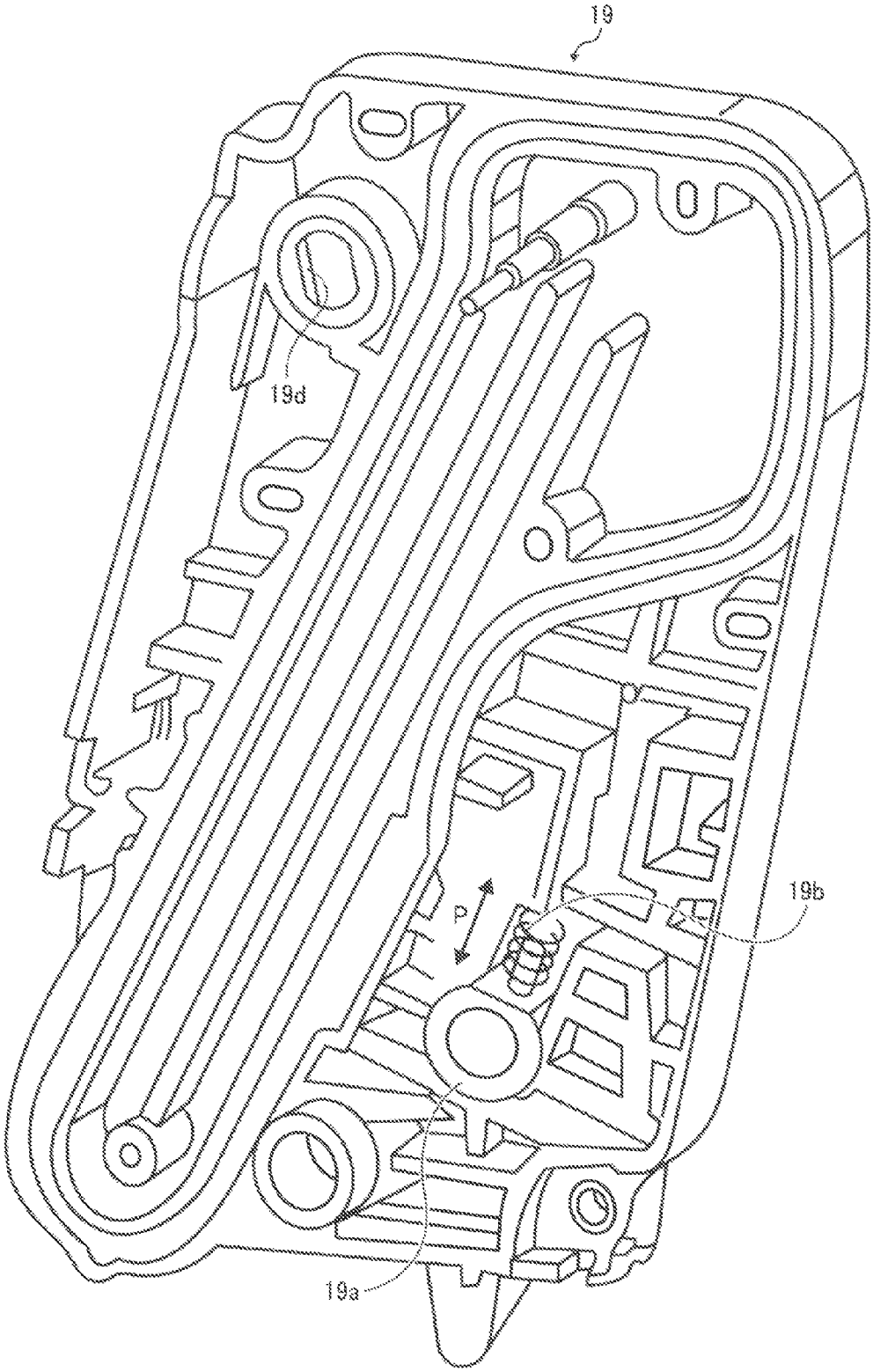
FIG. 7 is a perspective view showing the other faceplate.

In FIG. 3, the developer carrier 6*h* of the developing device 16 is supported on the developing device 16 by means of first bearings 6*h*1, 6*h*2 that are mounted on the left and right of a developer carrier housing 6*i*. On the left faceplate 18 that supports the developer carrier unit 16 and the image carrier unit 17, there is provided a second bearing 18*a* that supports the shaft end 6*h*3 of the developer carrier 6*h*, as shown in FIG. 4 and FIG. 6. Likewise, a second bearing 19*a* that supports the shaft end 6*h*3 of the developer carrier, as shown in FIG. 5 and FIG. 7, is provided on the right faceplate 19 that supports the developer carrier unit 16 and image carrier unit 17.

These second bearings 18*a*, 19*a* are slidable with the developing device 16 that is supported by the developer carrier 6*h* and first bearings 6*h*1, 6*h*2, in a direction such as to contact or move away from the image carrier 6*a*; pressing springs 18*b*, 19*b* are provided that press the left and right shaft ends 6*h*3 of the developer carrier 6*h* through the second bearings 18*a*, 19*a* in the direction of the image carrier 6*a*. Thanks to this configuration, in this example shown in FIG. 6 and FIG. 7 and other figures, the second bearings 18*a*, 19*a* are movable in the direction P.

Figure 8A:
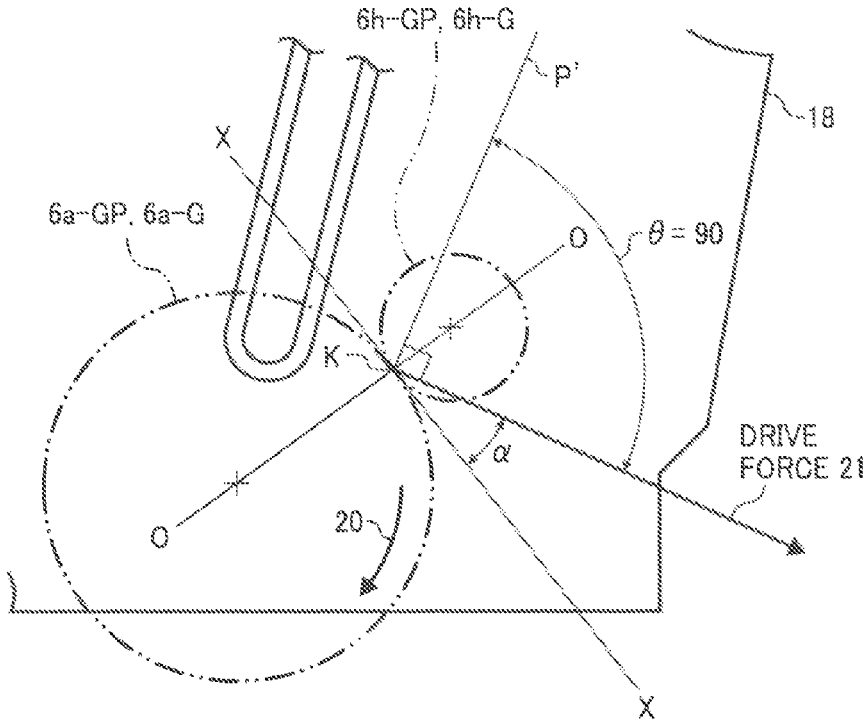
FIG. 8A is a view of showing the relationship between the drive force applied by a gear and the bearing sliding direction.
Figure 8B:
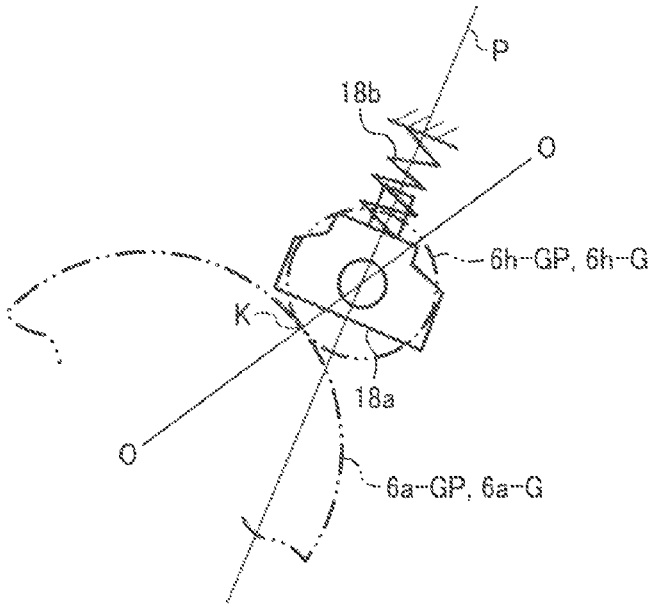
FIG. 8B is a view showing the sliding direction of a bearing.

The direction of movement P of these second bearings 18*a*, 19*a* and the positional relationship of the image carrier gear 6*a*-G and the developer carrier gear 6*h*-G will now be described with reference to FIG. 8A and FIG. 8B. FIG. 8A shows the arrangement and drive force of the gears and the sliding direction etc of the second bearings; FIG. 8B shows the second bearing 18*a* in the arrangement shown in FIG. 8A, separately in order to avoid complexity of the figure.

The image carrier gear 6*a*-G and the developer carrier gear 6*h*-G mesh directly, so the pitch circle 6*a*-GP of the image carrier gear 6*a*-G and the pitch circle 6*h*-G of the developer carrier gear 6*h*-G are in contact. The common tangent x-x of the two pitch circles 6*a*-G, 6*a*-GP is in a relationship that intersects orthogonally the straight line through the centers of the two pitch circles (the center of the image carrier and the center of the developer carrier).

When the image carrier 6*a* is rotated in the direction of the arrow 20 by a drive device (not shown), the developer carrier gear 6*h*-G that meshes with the image carrier gear 6*a*-G receives torque in the direction of the arrow 21. The direction of the drive force shown by the arrow 21 has an inclination of an angle $\alpha$ with respect to the common tangent x-x whose origin is the point of contact K of the two pitch circles: usually, the angle $\alpha$ is the gear pressure angle, typically 20°.

The sliding direction P' of the second bearing 18*a* on the drive side of the developer carrier 6*h* (drive side in the longitudinal direction of the shaft developer carrier i.e. the side of the left faceplate) is set so as to make an angle of about 90° with respect to the direction of the arrow 21, which is the direction of the drive force of the gear, so that this is pressed in the direction of the image carrier 6*a* by the pressing spring 18*b*.

This setting is a characteristic feature of the present invention and is such that sliding of the second bearings that support the shaft sections at both end sides in the shaft longitudinal direction of the developer carrier is made possible along the guidance section provided on the faceplate and that the developer carrier is pressed towards the image carrier by applying pressure by the pressing means provided by the pressing spring. Also, by setting the angle ($\theta$) of the sliding direction of the bearings to about 90° with respect to the direction of the drive force, the effect of the drive force applied to the developer carrier gear 6*h*-G on the pressing force of the developer carrier onto the image carrier is greatly reduced. In this example, since the component of the drive force on the sliding direction P' orthogonal to the direction of the drive force indicated by the arrow 21 in FIG. 8A and passing through the contact point K is zero, as shown in FIG. 8B, the drive force likewise has no effect even in the actual sliding direction P of the second bearing 18*a*, which is set to be parallel to the sliding direction P'. Consequently, assuming that the sliding resistance of the second bearing 18*a* and of the second bearing 19*a* are equal, no difference will be produced in the pressing force provided by the second bearings 18*a*, 19*a* on the drive side and the side opposite to the drive side of the developer carrier 6*h* if the same spring forces of the pressing springs 18*b*, 19*b* are employed.

Since there is no effect on the pressing force even if the gear torque is variable, the target pressing force can always be maintained. Also, in the contact developing system, the pressing force can be set to a low level, and this has great advantages in torque reduction. Although, in the embodiment example described above, the image carrier gear 6*a*-G and the developer carrier gear 6*h*-G are directly coupled, making it possible to adopt a compact configuration and offering the advantage of miniaturization of the units and main machine body, setting could be performed in the same way in respect of the main drive gear, even in the case where these are not directly coupled, such as for example in a case where the main drive gear of the color electrophotographic apparatus 1 drives the developer carrier gear 6*h*-G directly and the developer carrier gear 6*h*-G meshes with the image carrier gear 6*a*-G.

It should be noted that, in order for the developer carrier 6*h* to slide in this configuration, it is necessary that the developing device 16 in which the developer carrier 6*h* is incorporated should also be capable of sliding: in order to achieve this, the support section 18*d* of the developing device formed on the left faceplate 18 shown in FIG. 6 (FIG. 4) and the support section 19*d* of the developing device formed on the right faceplate 19 shown in FIG. 7 (FIG. 5) are respectively made slot-shaped, so as to permit sliding in the direction of the slots.

Since the developing device 16 is slidably supported with respect to the left and right faceplate 18 and 19 in this way and the pressing member and the bearings that support the developer carrier are provided within the faceplates, the developer carrier 6*h* can easily be separated from the image carrier 6*a*. Thanks to this configuration, movement of the second bearings 18*a*, 19*a* can be restrained by clamping for example a wedge-shaped stopper in second shaft operating windows 18*e* and 19*e* shown in FIG. 4 and FIG. 5, and also when shipping the developer carrier 6*h* can be held in a condition separated from the image carrier 6*a*. In this way, plastic deformation of the developer carrier due to being constantly subjected to pressure can be prevented. Also, removal from outside the left and right side faces can easily be performed by providing a release mechanism (wedge component) as aforesaid that separates the developer carrier from the image carrier.

It should be noted that, in cases where a configuration involving an image-forming unit 6 as described in the above example is not employed, as the means that slidably supports the second bearings, instead of the faceplates described above, an immobile member that holds this developing device, such as for example a side plate of the main body of the image forming apparatus, could be employed as the second bearing support means.

Figure 9:
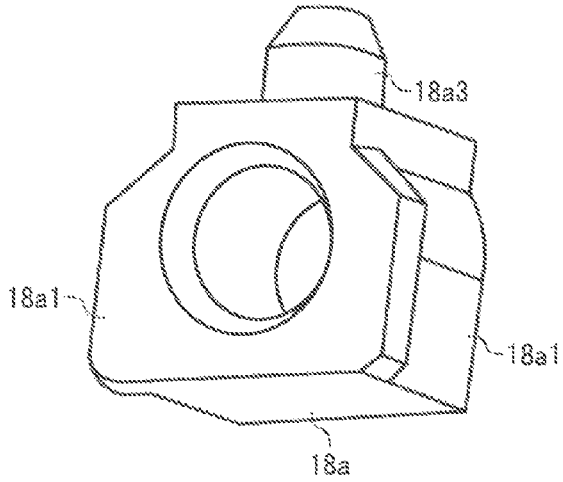
FIG. 9 is a perspective view showing an example of the bearing.
Figure 10:
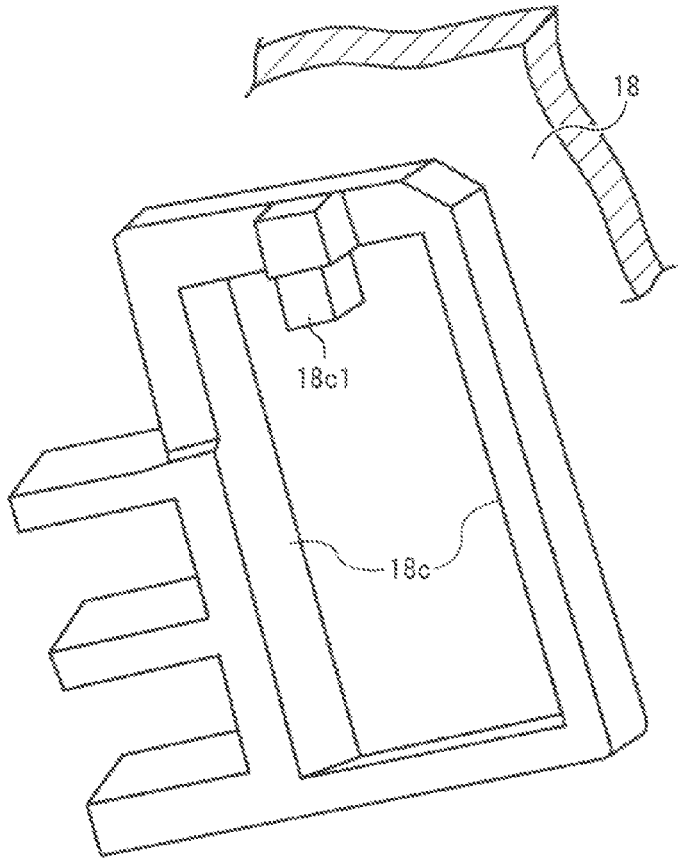
FIG. 10 is a perspective view showing a guidance section that guides the bearing, provided on a faceplate.

FIG. 9 shows an example of the second bearing 18*a* provided within the left faceplate 18. In the second bearing 18*a*, a sliding face 18*a*1 has a planar shape that slides on the left faceplate 18. This planar section slides over a sliding face 18*c* comprising a planar section that is parallel with and opposite to the left faceplate 18 shown in FIG. 10. However, as shown in FIG. 8A and FIG. 8B, drive force shown by the arrow 21 is applied to the developer carrier gear 6*h*-G, so that a large force is applied to the sliding face 18*a*1 through the developer carrier 6*h*.

Figure 11:
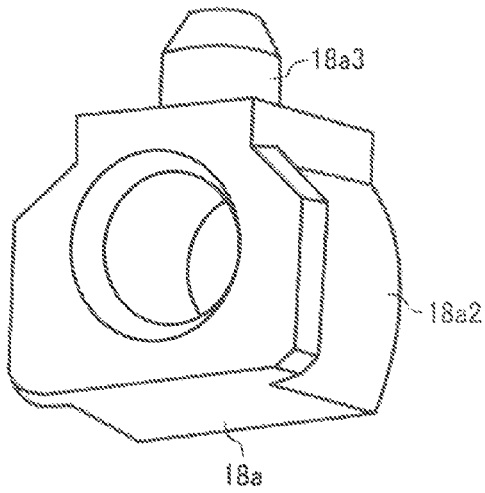
FIG. 11 is a perspective view showing another example of a bearing.
Figure 12:
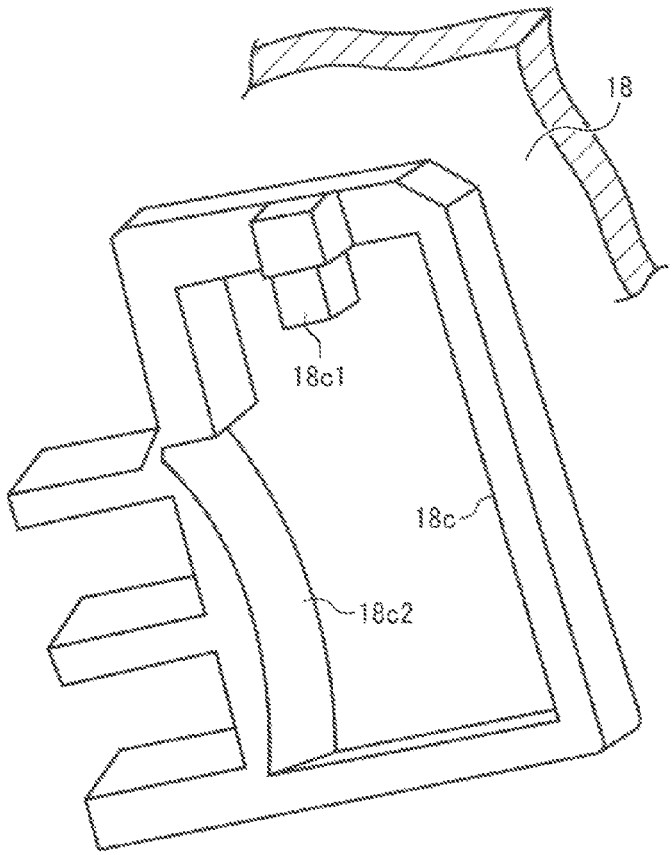
FIG. 12 is a perspective view of a guidance section that guides the bearing, provided on a faceplate.

Thus there may be concern that, since the sliding resistance is large in the sliding of one planar section against another planar section, the prescribed pressing force may not be applied. Accordingly, the prescribed pressing force of the developer carrier onto the image carrier can be guaranteed by reducing the sliding force of the sliding faces by making the region where the guidance section comes into sliding contact with the second bearing a combination of a curved face and a planar face, by adopting a circular shape (curved face) for the sliding face 18*a*2 of the second bearing 18*a* at at least one face of the bearing, as shown in FIG. 11. Taking into consideration the need for stability of direction when sliding, preferably only one face is made of circular shape (curved face). It should be noted that, in order to hold the pressing spring 18*b* there are respectively provided a projection 18*a*3 on the second bearing 18*a* and a projection 18*c*1 on the left faceplate 18. As shown in FIG. 12, the same benefit is obtained with a sliding face 18*c*2 wherein at least one face of the faceplate has a sliding face shape on the side of the left faceplate 18 formed in circular shape (curved face). The second bearing 19*a* on the opposite side of the developer carrier 6*h* to that referred to above may also be constructed in the same way. In this way, in regard to the sliding faces with the faceplates of the bearings, by making at least one side face of the bearing or at least one side face of the guidance section of the faceplate of circular shape, frictional force between the bearings and faceplates can be reduced even when gear drive force is applied, thereby making it possible to guarantee the prescribed pressing force.

Figure 13A:
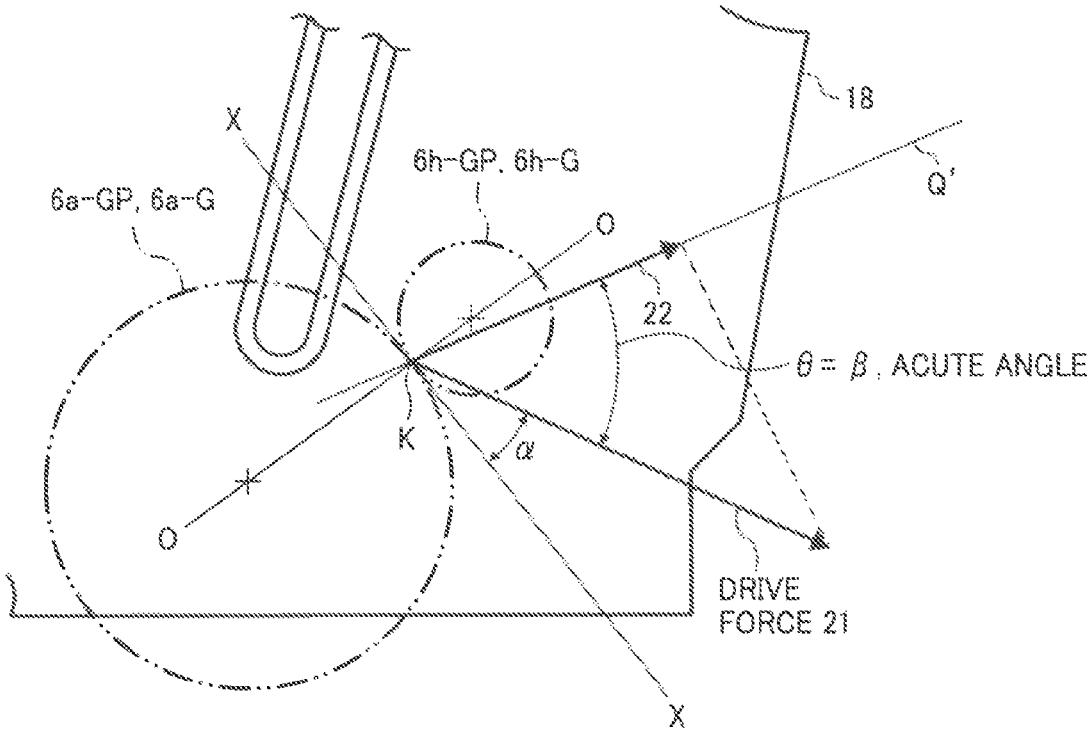
FIG. 13A is a view showing the relationship between the drive force applied by a gear and the bearing sliding direction.
Figure 13B:
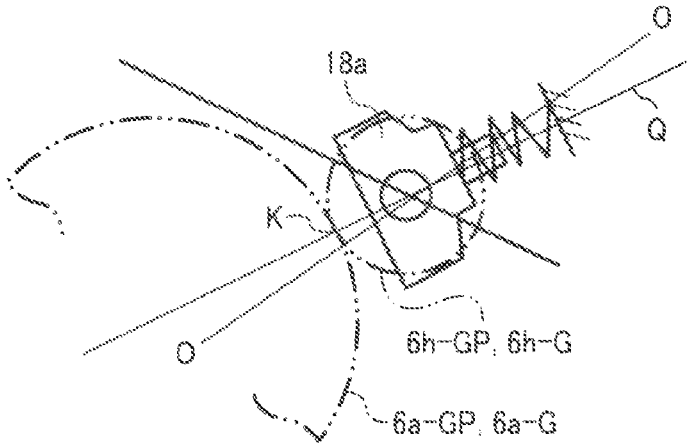
FIG. 13B is a view showing the sliding direction of a bearing.

As described above, in the example described with reference to FIG. 8, by making the angle of the drive force and the sliding direction of the second bearing 90°, the effect of the drive force indicated by the arrow 21 is reduced. Next, as shown in FIG. 13A and FIG. 13B, the angle (θ) of the sliding direction Q' of the second bearing 18*a* with respect to the direction of the drive force shown by the arrow 21 is made an acute angle β, and, in the case where a direction passing through the contact point K is adopted, the component 22 of the drive force (arrow 21) on the sliding direction Q' acts in a direction so as to separate the developer carrier 6*h* from the image carrier 6*a*.

In this case, by making the force of the pressing spring 18*b* large with respect to the second bearing 18*a*, which is on the drive side, and the force of the pressing spring 19*b* large with respect to the second bearing 19*a*, which is on the side opposite to the drive side, uniform pressing force with respect to the developer carrier 6*h* is obtained. Consequently, uniform pressing force can be guaranteed by setting the pressing force Fk that is applied to the second bearing on the side where the gear is provided and the pressing force Fh that is applied to the second bearing on the opposite side to that where the gear is provided so as to be in the relationship Fk>Fh. The same can be said in regard to the actual sliding direction Q of the second bearing 18*a* that is set parallel to the sliding direction Q' shown in FIG. 13B.

Figure 14A:
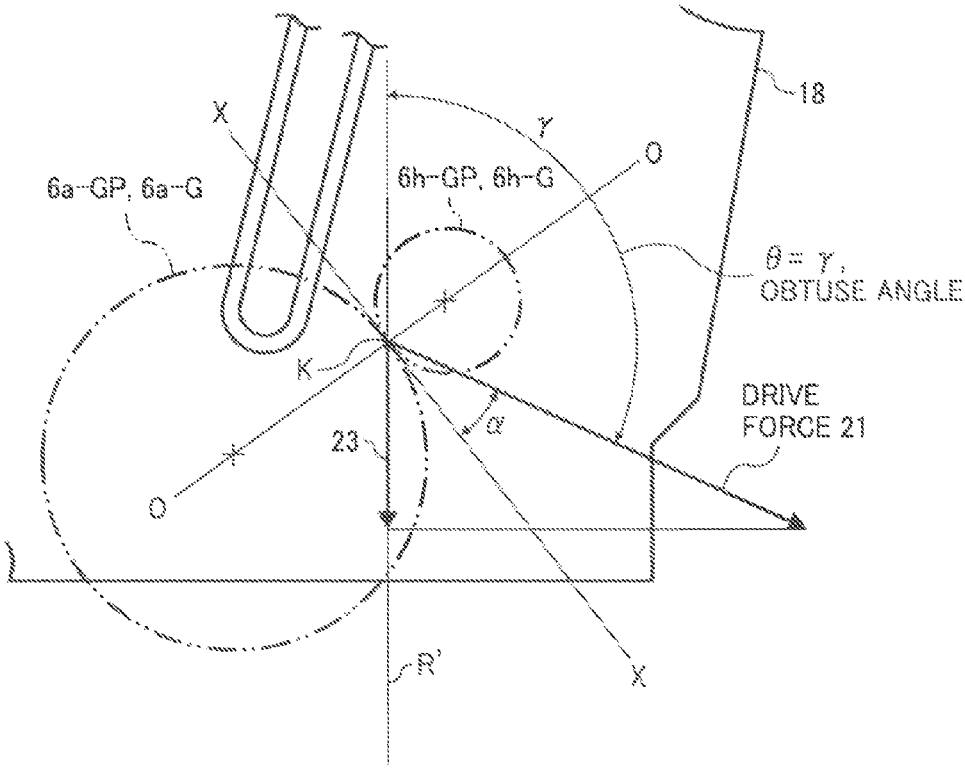
FIG. 14A is a view showing the relationship between the drive force applied by a gear and the bearing sliding direction.
Figure 14B:
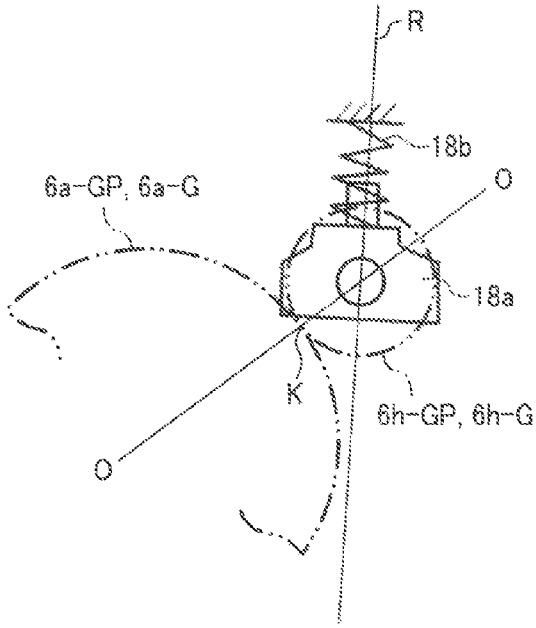
FIG. 14B is a view showing the sliding direction of a bearing.

Next, as shown in FIG. 14A and FIG. 14B, when the angle (θ) of the sliding direction R' of the second bearing 18*a* with respect to the direction of the drive force shown by the arrow 21 makes an obtuse angle γ and this is in a direction that passes through the contact point K, the component 23 of the drive force (arrow 21) on the sliding direction R' acts in a direction such as to press the developer carrier 6*h* against the image carrier 6*a*.

In this case, uniform pressing force with respect to the developer carrier 6*h* is obtained by reducing the force of the pressing spring 18*b* with respect to the second bearing 18*a* which is on the drive side and reducing the force of the pressing spring 19*b* with respect to the second bearing 19*a* which is on the side opposite to the drive side. Consequently, uniform pressing force can be guaranteed by setting the pressing force Fk that is applied to the second bearing on the side where the gear is provided and the pressing force Fh that is applied to the second bearing on the opposite side to that where the gear is provided so as to be in the relationship Fk<Fh. The same can be said in regard to the actual sliding direction R of the second bearing 18*a* that is set parallel to the sliding direction R' shown in FIG. 14B.

Figure 15:
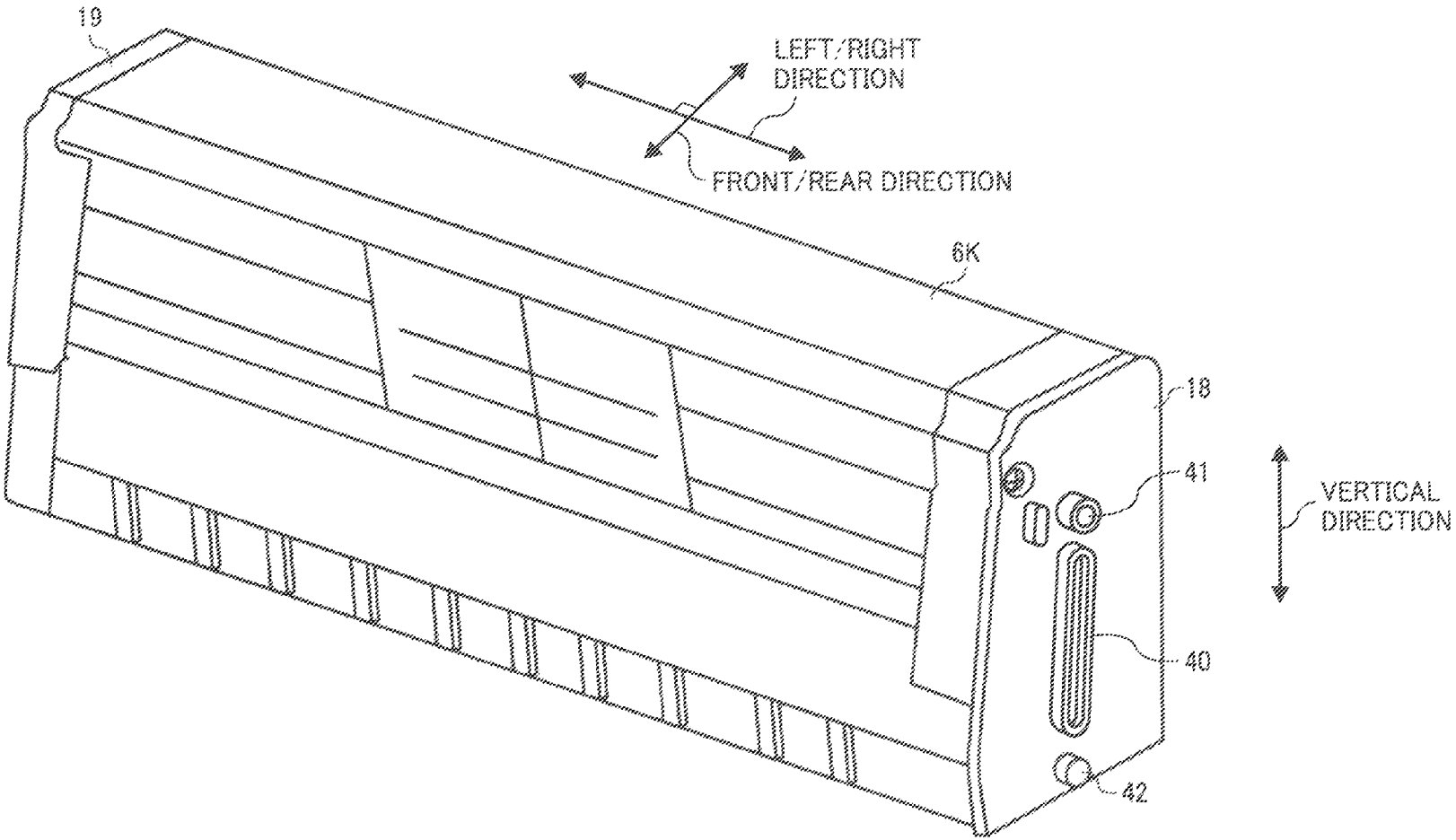
FIG. 15 is an external perspective view showing a process cartridge according to the present invention.
Figure 16:
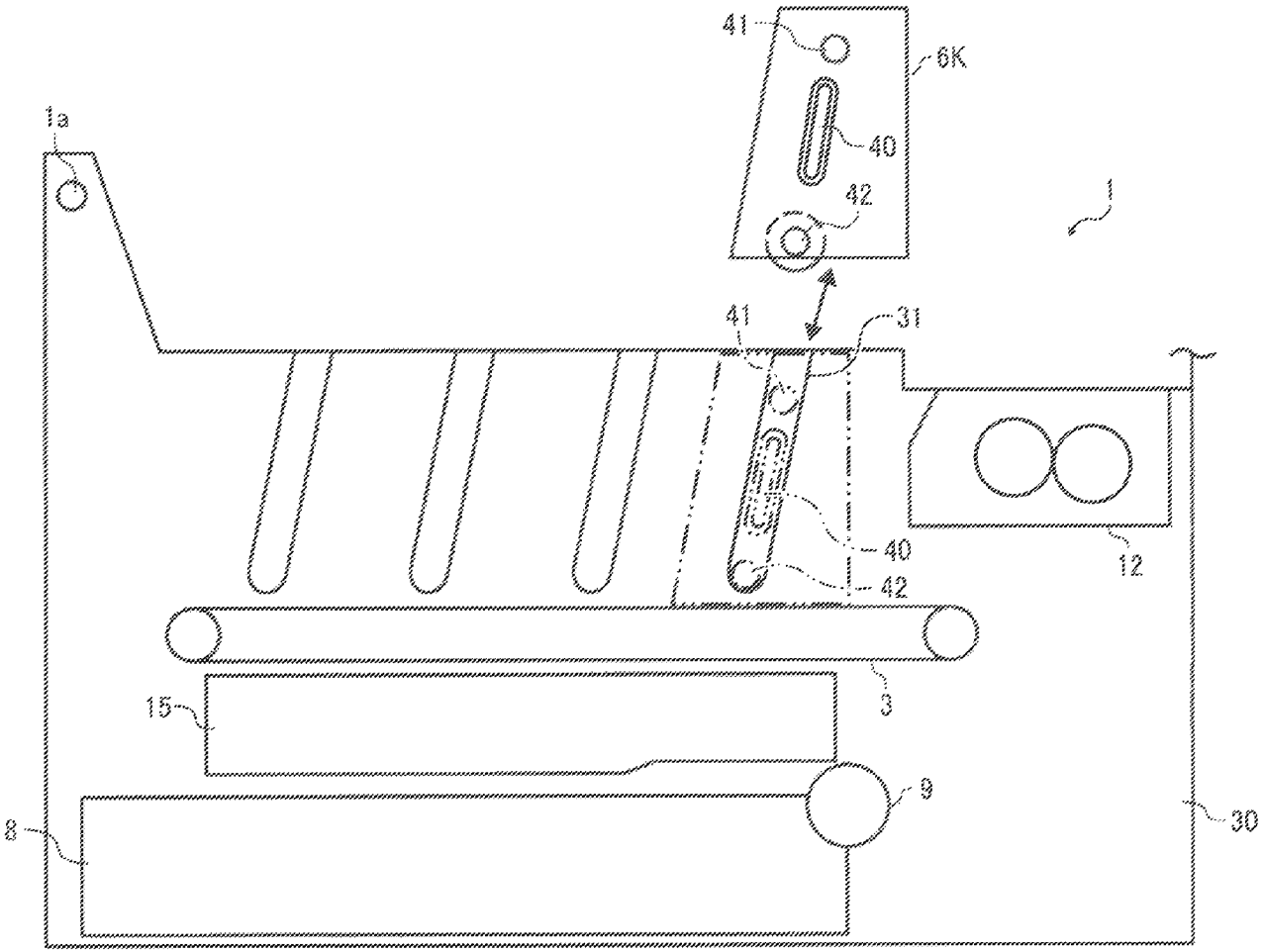
FIG. 16 is a view given in explanation of the mode of attachment/detachment of the process cartridge with respect to the main body of the image forming apparatus.

In the above, a process cartridge was described as an example of the embodiment. An outline view of a process cartridge having the configuration of the example of the embodiment described above is shown in FIG. 15. This process cartridge 6K corresponds to a black image-forming unit 6K as shown in FIG. 1; as shown in FIG. 16, this is detachable, being guided in U-shaped guide grooves 31 provided in side plates 30 of the main body of the color electrophotographic apparatus 1.

An elongate guide projection 40 is provided on the left faceplate 18 of the process cartridge 6K in the vertical direction and respective shaft-shaped projections 41, 42 are provided at the front and rear on the extension of the guide projection 40. The lower shaft-shaped projection 42 engages with a guide groove (recessed section) 31 to define the left/right and front/rear location of the lowermost position of the process cartridge 6K. The guide projection 40 serves solely to achieve a guiding function when mounting. The upper shaft-shaped projection 41 engages with the guide groove 31 and defines the position in the direction of rotation about the shaft-shaped projection 42. The right faceplate 19 is detached and located in position by a similar configuration. The same applies to the other process cartridges such as the cyan image-forming unit 6C, the magenta image-forming unit 6M, and the yellow image-forming unit 6Y.

Since, according to the present invention, the developing device and the image carrier are integrally supported and constitute a process cartridge that is detachable with respect to the main body of the image forming apparatus, a process cartridge of excellent maintenance and replacement characteristics can be provided. Also, with an image forming apparatus in which such a process cartridge is mounted, an excellent printed image (copied image) can always be provided.

Figure 17:
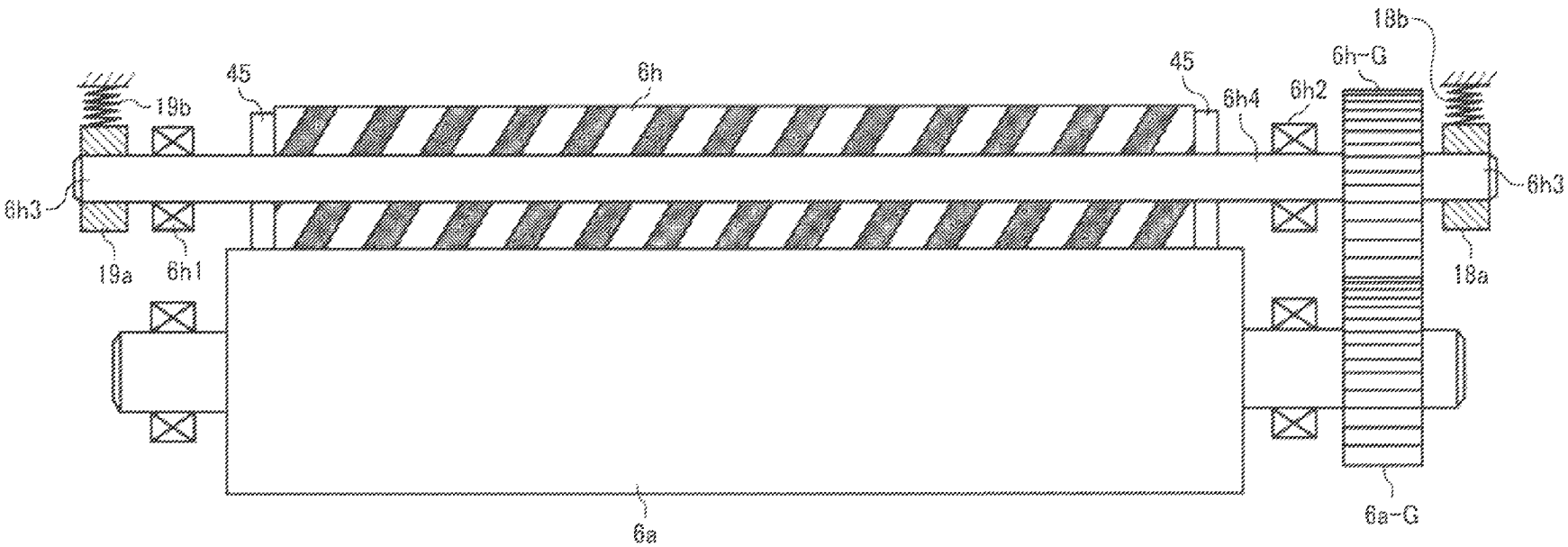
FIG. 17 is a cross-sectional front view showing an example of the mode in which the image carrier and developer carrier are brought into contact in a contact developing system.
Figure 18:
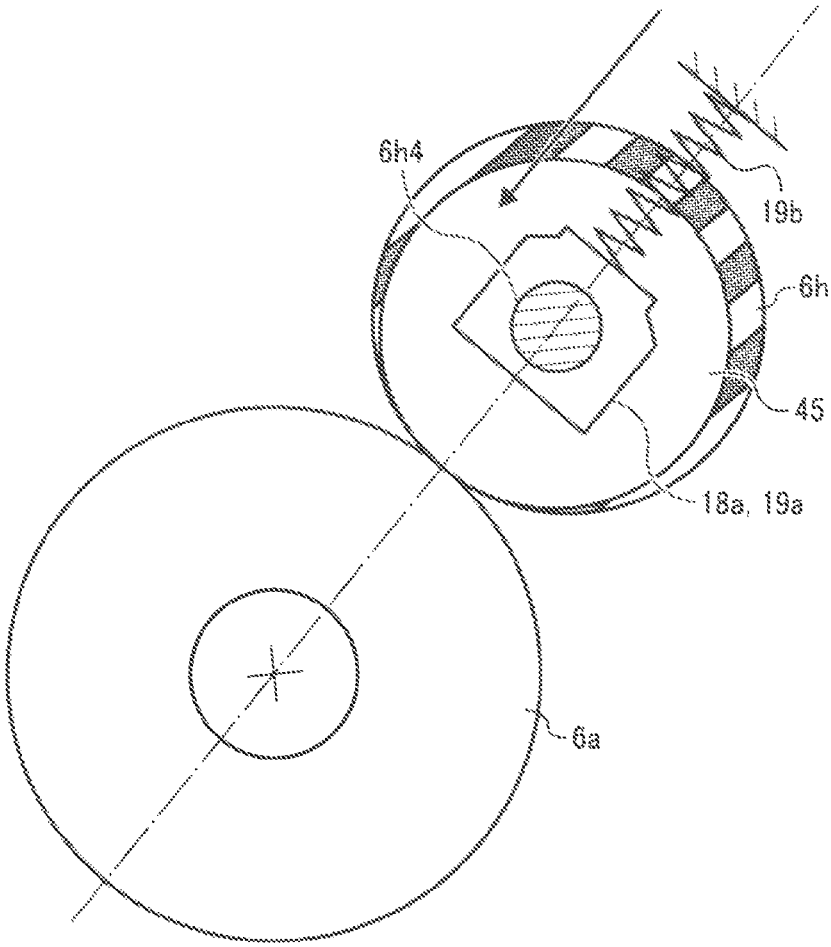
FIG. 18 is a cross-sectional view seen from the axial direction of the mode in which the image carrier and developer carrier are brought into contact in a contact developing system.

[3] Configuration for Bringing the Developer Carrier into Contact with the Image Carrier In this example of the embodiment, a configuration is adopted in which a developing roller 6*h* is brought into contact with the image carrier 6*a*, so that contact development can be performed. Specifically, as shown in FIG. 17 and FIG. 18, rollers 45 constituted by rigid bodies are provided on the left and right at the shaft sections 6*h*4 of the developing roller 6*h* as limiting members to define the upper limit of movement in the pressing-in direction by the pressing springs 18*b*, 19*b* so that an excessive contacting state of the developing roller 6*h* with respect to the image carrier 6*a* is not produced.

The left and right rollers 45 are disc-shaped and concentric with the shaft sections 6*h*4, and have the same diameter, their external diameter dimension being slightly smaller than the external diameter of the developing roller 6*h*. Furthermore, the portion where the developing roller 6*h* contacts the image carrier 6*a* i.e. around the shaft sections 6*h*4 is covered with a tubular resilient body, as shown in cross-section in the figure. Also, as already described, the shaft sections 6*h*4 are biased in a direction such as to approach the image carrier 6*a* by means of pressing springs 18*b*, 19*b*. Consequently, the resilient body can flex by the amount of the difference in dimensions of the developing roller 6*h* and the roller 45, so that, as a result, the movement of the developing roller 6*h* is restricted to a condition in which the outer circumference of the roller 45 contacts the image carrier 6*a*, as shown in FIG. 17 and FIG. 18.

The hardness of the resilient body is suitably about 25° to 50° (Asker C). A uniform nip pressure as between left and right is obtained on the basis of a condition in which the left and right rollers 45 are both in contact with the image carrier 6*a*. By employing the rollers 45, the upper limit of pressing in can be restricted, so that, even if there are irregular factors that could cause excessive pressing in, the pressing in is restricted by the stopper function presented by the rollers 45, and increase in the load as for example during meshing of the developer carrier gear 6*h*-G with the image carrier gear 6*a*-G is avoided, so increase in the torque load of the apparatus as a whole can be prevented.

With the present invention, the problems that arose with the prior art can be solved.

For example, in Prior Art 3 referred to above, stable quality of contact is maintained by employing a mechanism that performs fine adjustment of the distance between the shafts to deal with bending of the developing roller that occurs when the distance between the shafts of the developing roller and the photosensitive body is fixed at a given dimension, and image defects such as white stripes. Conventionally, this is a problem that can be avoided by selection of diameter and/or materials such that the developing roller does not flex, but, in the field of small printers, as in Prior Art 3 referred to above, miniaturization of the members was considered necessary to a degree necessitating adjustment of the distance between the shafts of the developing roller and the photosensitive body. By employing the present invention, even under conditions such as obtain in the field of small printers, the quality of contact can be stabilized without needing to provide a mechanism for adjusting the distance between the shafts as in Prior Art 3.

[3] Configuration for Bringing the Developer Carrier Out of Contact with the Image Carrier In the example of the present embodiment, a configuration is adopted whereby the developing roller 6*h*' is brought out of contact with the image carrier 6*a* so as to perform non-contacting development. Specifically, as shown in FIG. 19 and FIG. 20, rollers 45' constituted by rigid bodies are provided on the left and right at the shaft sections 6*h*4 of the developing roller 6*h*' as limiting members to restrict movement in the pressing-in direction by the pressing springs 18*b*, 19*b* so that the separation dimension of the developing roller 6*h* with respect to the image carrier 6*a* is fixed.

Figure 19:
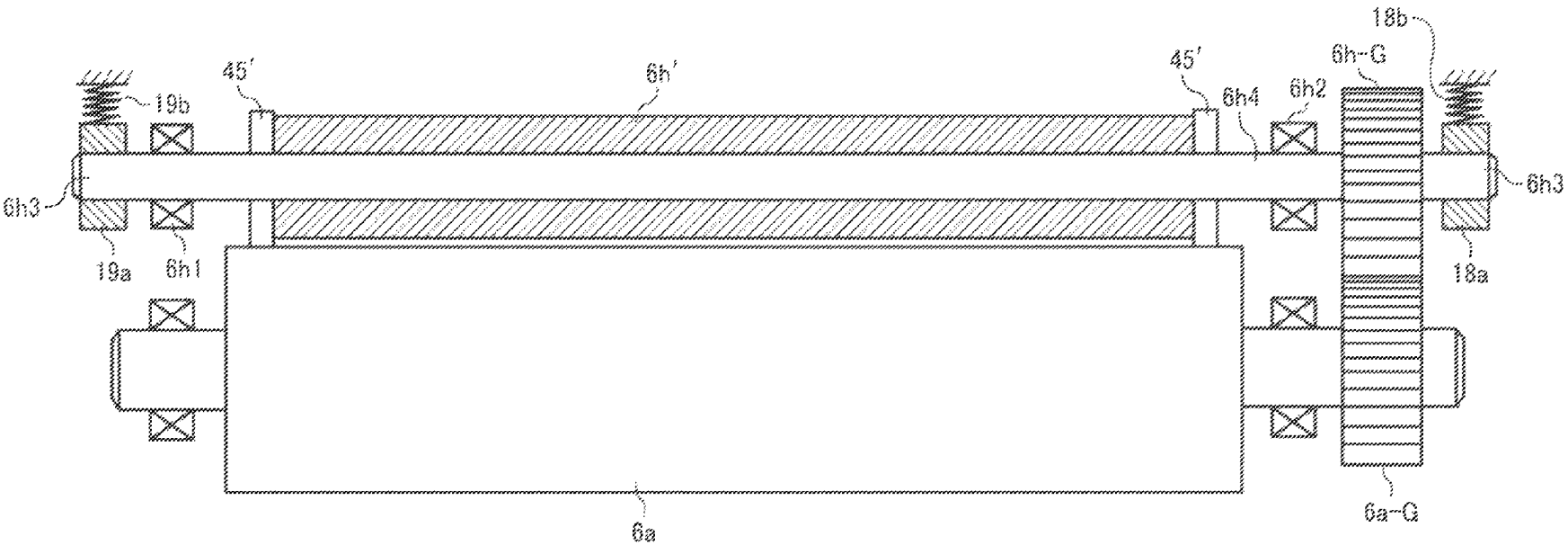
FIG. 19 is a cross-sectional front view showing an example of the mode in which the image carrier and developer carrier are brought into contact in a non-contact developing system.
Figure 20:
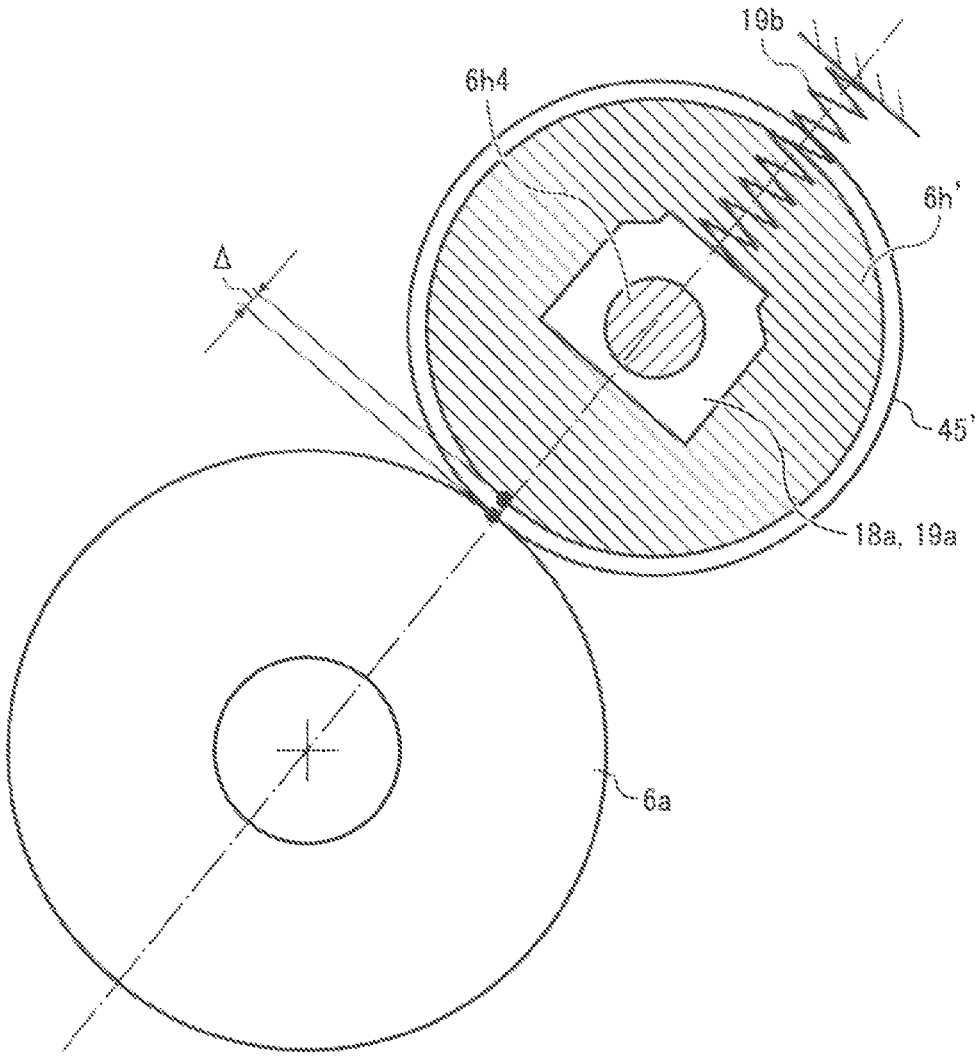
FIG. 20 is a cross-sectional view seen from the axial direction of the mode in which the image carrier and developer carrier are brought into contact in a non-contact developing system.

As shown in FIG. 19 and FIG. 20, in contrast to the example illustrated in FIG. 17 and FIG. 18, the external diameter of the rollers 45' is made slightly larger than the external diameter of the developing roller 6*h*' in order to ensure separation between the developing roller 6*h*' and the image carrier 6*a*. Although the developing roller 6*h*' is covered with a tubular member as shown in cross-section in the figure around the shaft section 6*h*4, there is no need that this should be a resilient member. Thanks to the left and right rollers 45', the separation distance Δ between the developing roller 6*h*' and the image carrier 6*a* is maintained at a fixed amount even when the developing roller 6*h*' is rotated.

[4] Mounting Mode of the Process Cartridge in Respect of the Image Forming Apparatus Although the mode in which the process cartridge 6K is mounted in the color electrophotographic apparatus 1 is as already described in FIG. 16 and the corresponding description, further detailed description will now be given concerning the mode in which the process cartridge is mounted with respect to the image forming apparatus.

Figure 21:
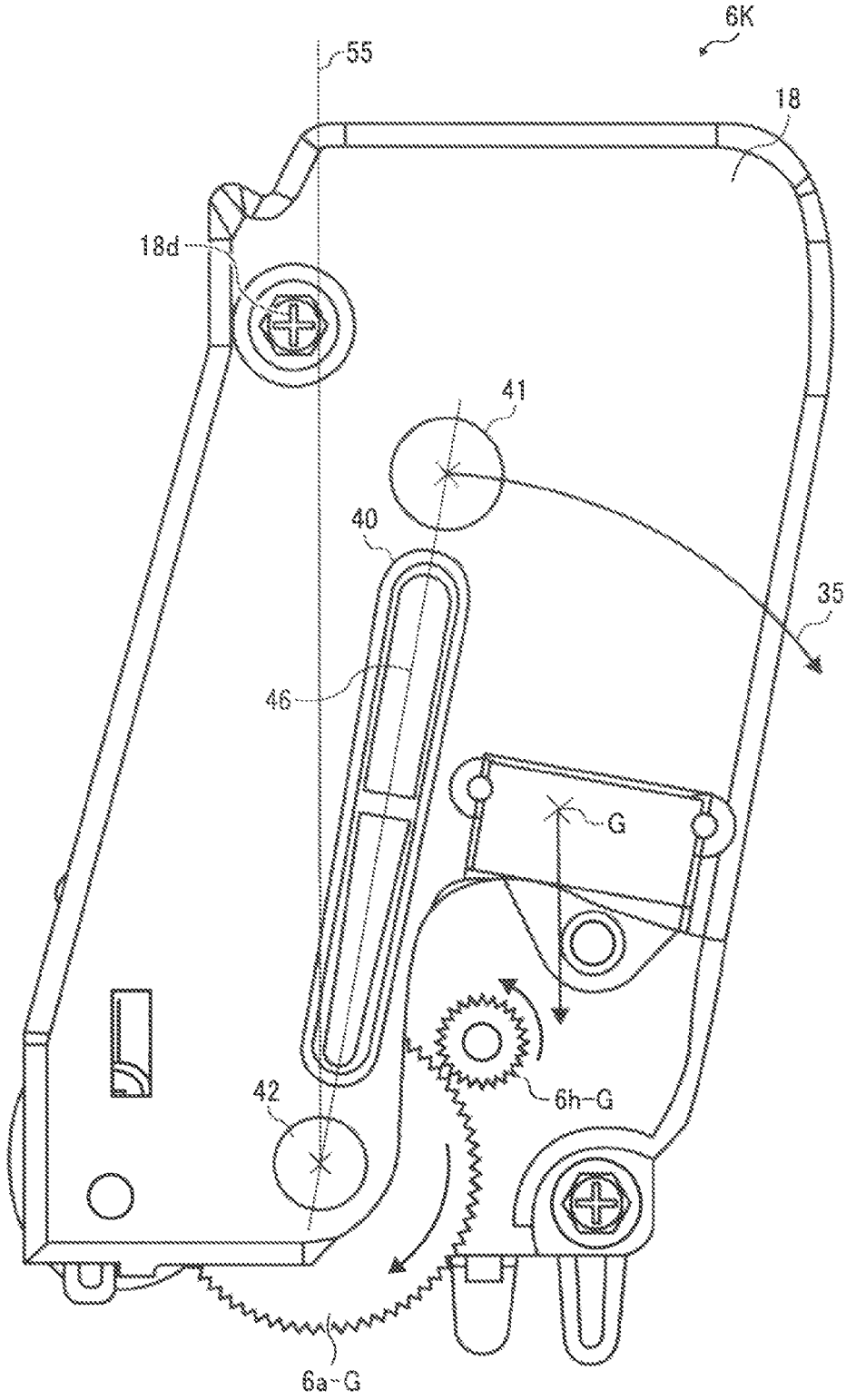
FIG. 21 is a view showing an example of the torque that acts on a process cartridge mounted in an image forming apparatus.

Let us assume that the process cartridge 6K is mounted in a condition as shown in FIG. 21 with respect to the color electrophotographic apparatus 1. In FIG. 21 showing the left faceplate 18 seen from the front, the convex shaft-shaped projection 42 constituting the main reference is concentric with the image carrier 6*a*; let us denote the line connecting the center of this shaft-shaped projection 42 and the center of the convex shaft-shaped projection 41 constituting the subsidiary reference as 46. Also, if we designate the perpendicular line passing through the center of the shaft-shaped projection 42 as the line 55, the center of gravity G of this process cartridge 6K is positioned on the right hand side of the line 55. In this way, the torque in the clockwise direction as shown by the arrow 35 is received by the process cartridge 6K about the shaft-shaped projection 42 as center.

Now when the developing device is driven, the image carrier gear 6*a*-G is driven in rotation in the clockwise direction by the drive source on a drive path, not shown, as indicated by the arrow, so that the developer carrier gear 6*h*-G constituting the driven gear wheel is passively rotated. In transmission of drive force by meshing of the two gears, the process cartridge 6K receives torque in the clockwise direction as shown by the arrow 35, about the shaft-shaped projection 42.

Thus the configuration is such that the direction of rotation produced by the torque about the shaft-shaped projection 42 that is received by the process cartridge 6K due to the drive force applied to the developer carrier gear 6*h*-G and the direction of rotation produced by the torque about the shaft-shaped projection 42 that the process cartridge receives due to its own weight are the same. By means of this configuration, the process cartridge 6K can be held in stable fashion with respect to the color electrophotographic apparatus 1 and the image quality can therefore be stabilized.

The reasons for this are described below.

Figure 22:
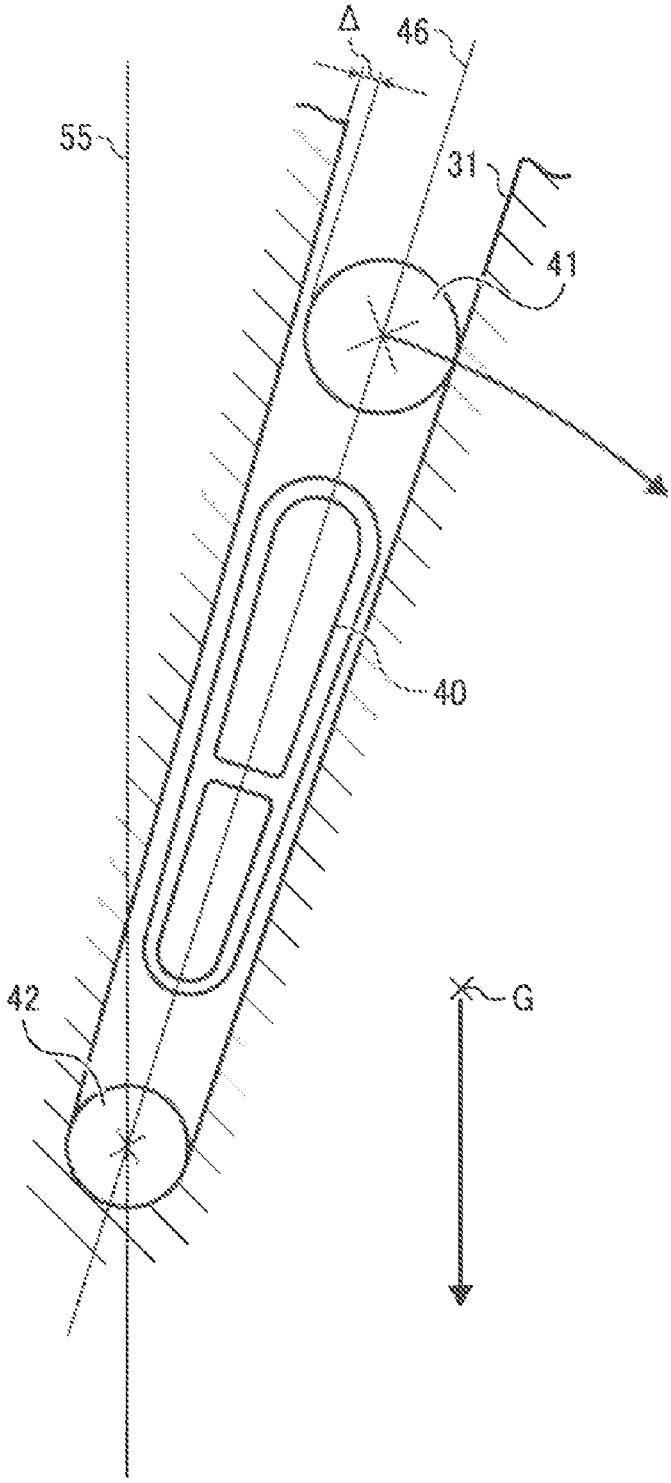
FIG. 22 is a partial cross-sectional view showing an example of the gap in a fitting section of a guide groove and shaft-shaped projection.

As shown in FIG. 22, the fitting relationship of the shaft-shaped projection 41 with respect to the guide groove 31 of the process cartridge mounted in the attitude shown in FIG. 21 is arranged to be such that this fitting is comparatively loose, with a view to for example smoothness of operation when mounting the cartridge, and a gap Δ1 is thus produced. If a configuration is adopted such that the direction of rotation produced by the torque about the shaft-shaped projection 42 that is received by the process cartridge 6K due to the drive force applied to the developer carrier gear 6*h*-G and the direction of rotation produced by the torque about the shaft-shaped projection 42 that the process cartridge receives due to its own weight are the same, the shaft-shaped projection 41 always abuts the right wall face of the guide groove 31 due to the action of the torque due to its own weight, irrespective of drive force from the image carrier gear 6*a*-G with respect to the developer carrier gear 6*h*-G.

Figure 23A:
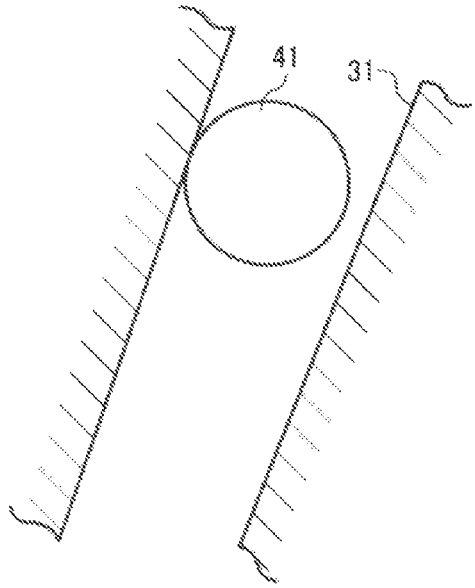
FIG. 23A is a view showing the condition in which the shaft-shaped projection contacts the left wall face of the gap in the fitting section of the guide groove and shaft-shaped projection.
Figure 23B:
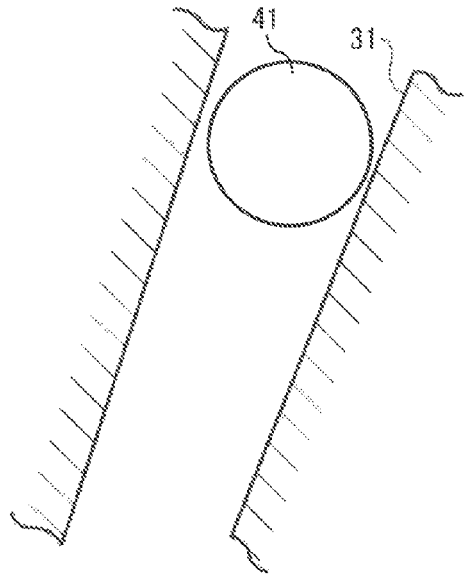
FIG. 23B is a partial cross-sectional view showing the condition in which the shaft-shaped projection contacts the left wall face of the gap in the fitting section of the guide groove and shaft-shaped projection.

In contrast, if the situation were to be imagined in which the position of the center of gravity G of the process cartridge 6K in FIG. 22 were positioned on the left-hand side of the line 55, when there is no drive force from the image carrier gear 6*a*-G with respect to the developer carrier gear 6*h*-G, because the process cartridge 6K receives torque in the anti-clockwise direction about the shaft-shaped projection 42 due to its own weight, the shaft-shaped projection 41 would assume a state abutting the left wall face of the guide groove 31 as shown in FIG. 23A. Also, when drive force from the image carrier gear 6*a*-G in respect of the developer carrier gear 6*h*-G is produced, if the torque due to this drive force exceeds the torque due to its own weight, the shaft-shaped projection 41 assumes a state abutting the right wall face of the guide groove 31 as shown in FIG. 23B.

In this way, every time the developing device is driven and stopped, the shaft-shaped projection 41 abuts the two wall faces of the guide groove 31 alternately, impairing stable position holding of the process cartridge 6K. With this example of the embodiment, the situation as in the above comparative example cannot arise, so the process cartridge 6K can be held in a stable position irrespective of drive/stopping of the developing device. It should be noted that, although the present example was a case in which the developer carrier 6*h* was driven by the drive source from the image carrier 6*a*, there is no restriction to this and even for example in a case where the developer carrier 6*h* and image carrier 6*a* are driven by separate drive sources, there is a risk of the same problem arising as in the case of the comparative example of FIG. 23A and FIG. 23B described above if the process cartridge is subjected to torque when these are respectively driven, and the present invention can be applied in such a case.

Hereinabove, according to the present invention, a developing device, process cartridge and image forming apparatus can be provided wherein the effect of the developer carrier on the pressing force onto the image carrier due to the gear drive force can be eliminated. Also if the contact developing system is adopted, the spring pressing force can be set to the minimum, which is also beneficial in torque reduction.

Various modifications will become possible for those skilled in the art after receiving the teachings of the present disclosure without departing from the scope thereof.

What is claimed is:

1. A developing device, comprising:

an image carrier, a developer carrier configured to be driven in rotation by a drive force applied to a gear provided on a shaft section thereof, the developer carrier being pressed in the direction of the image carrier, wherein a bearing that supports the shaft section is made slidable and the sliding direction of the bearing is set at about 90° with respect to a direction of the drive force, wherein the bearing is slidably supported along a guidance section positioned at either end in the shaft longitudinal direction, and is subjected to pressure by a pressing means, and wherein a surface where the guidance section comes into sliding contact with the bearing includes a combination of a curved face and a planar face.

2. The developing device as claimed in claim 1, wherein a gear of the developer carrier is directly coupled with a gear of the image carrier.

3. A developing device, comprising:

an image carrier;

a developer carrier configured to be driven in rotation by a drive force applied to a gear provided on a shaft section thereof, the developer carrier being pressed in the direction of the image carrier, wherein a bearing that supports the shaft section is made slidable, and the pressing force Fk with which the bearing is pressed on the side where the gear is provided in the longitudinal direction of the shaft section and the pressing force Fh with which the bearing is pressed on the side opposite to the side where the gear is provided in the longitudinal direction of the shaft section are respectively set as follows in accordance with the magnitude of an angle (θ) of the sliding direction of the bearing with respect to the direction of the drive force:

when $\theta<90°$: $Fk>Fh$;

when $\theta=90°$: $Fk=Fh$; and when $\theta>90°$: $Fk<Fh$.

4. The developing device as claimed in claim 3, wherein a gear of the developer carrier is directly coupled with a gear of the image carrier.

5. The developing device as claimed in claim 3, wherein a bearing of the developer carrier is slidably supported along a guidance section provided on a faceplate positioned at either end in the shaft longitudinal direction, and is subjected to pressure by pressing means.

6. The developing device as claimed in claim 5, wherein at least part of a region where the guidance section comes into contact with the bearing includes a combination of a curved face and a face providing sliding friction in a linear contacting state.

7. A process cartridge that is detachable with respect to a main body of an image forming apparatus and that integrally supports at least a developing device and an image carrier, wherein the developing device includes a developer carrier that is driven in rotation by drive force applied to a gear provided on a shaft section thereof, the developer carrier being pressed in the direction of an image carrier, a bearing that supports the shaft section being made slidable and the sliding direction of the bearing being set at about 90° with respect to the direction of the drive force, wherein the bearing is slidably supported along a guidance section positioned at either end in the shaft longitudinal direction, and is subjected to pressure by a pressing means, and wherein a surface where the guidance section comes into sliding contact with the bearing includes a combination of a curved face and a planar face.

8. An image forming apparatus comprising:

a process cartridge, wherein the process cartridge is detachable with respect to a main body of an image forming apparatus and integrally supports at least a developing device and an image carrier, and wherein the developing device includes a developer carrier that is driven in rotation by drive force applied to a gear provided on a shaft section thereof and that presses the developer carrier in the direction of an image carrier, the bearing that supports the shaft section being made slidable and the sliding direction of the bearing being set at about 90° with respect to a direction of the drive force, wherein the bearing is slidably supported along a guidance section positioned at either end in the shaft longitudinal direction, and is subjected to pressure by a pressing means, and wherein a surface where the guidance section comes into sliding contact with the bearing includes a combination of a curved face and a planar face.

9. The image forming apparatus as claimed in claim 8, wherein development is performed in a condition with the developer carrier brought into contact with the image carrier.

10. The image forming apparatus as claimed in claim 9, wherein a limiting member is provided on the shaft section of the developer carrier, which limits a movement of the image carrier in the pressing direction such that an excessive contacting state of the image carrier and the developer carrier is not produced.

11. The image forming apparatus as claimed in claim 10, wherein a part of the developer carrier, which comes into contact with the image carrier, is provided with a resilient body.

12. The image forming apparatus as claimed in claim 11, wherein the hardness of the resilient body is 25° to 50° (Asker C).

13. The image forming apparatus as claimed in claim 8, wherein development is performed in a condition with the developer carrier separated from the image carrier.

14. The image forming apparatus as claimed in claim 8, wherein the image forming apparatus is configured such that the process cartridge is detachable with respect to the image forming apparatus, a convex-shaped main reference and subsidiary reference that fit a concave-shaped section of the image forming apparatus are respectively provided on the left and right faceplates of the process cartridge, as positioning references when mounting to the image forming apparatus, the main reference defines the lower limiting position of the process cartridge and the left/right, front/rear position thereof, and the subsidiary reference defines a position in the direction of rotation of the process cartridge about the main reference as a fulcrum, and the direction of rotation about the main reference as a fulcrum, which is received by the process cartridge due to drive force applied to the gear provided on the shaft section of the developing device, is the same as the direction of rotation about the main reference as a fulcrum, which is received by the process cartridge due to its own weight.

* * * * *